US009044641B2

(12) United States Patent
Velikin et al.

(10) Patent No.: US 9,044,641 B2
(45) Date of Patent: Jun. 2, 2015

(54) PORTABLE DOORWAY RECREATION APPARATUS

(76) Inventors: Peter Hristov Velikin, Boston, MA (US); Kiril Stefan Alexandrov, Cambridge, MA (US)

( * ) Notice: Subject to any disclaimer, the term of this patent is extended or adjusted under 35 U.S.C. 154(b) by 0 days.

(21) Appl. No.: 13/877,936

(22) PCT Filed: Aug. 24, 2012

(86) PCT No.: PCT/US2012/052335

§ 371 (c)(1),
(2), (4) Date: May 9, 2014

(87) PCT Pub. No.: WO2013/052213

PCT Pub. Date: Apr. 11, 2013

(65) Prior Publication Data

US 2014/0302968 A1 Oct. 9, 2014

Related U.S. Application Data

(63) Continuation-in-part of application No. PCT/US2011/054925, filed on Oct. 5, 2011.

(60) Provisional application No. 61/389,826, filed on Oct. 5, 2010.

(51) Int. Cl.
*A63B 1/00* (2006.01)
*A63B 21/068* (2006.01)
(Continued)

(52) U.S. Cl.
CPC ..... *A63B 21/068* (2013.01); *Y10T 29/49826* (2013.01); *A63B 1/00* (2013.01);
(Continued)

(58) Field of Classification Search
CPC ..... A63B 21/1627; A63B 23/1218; A63B 21/1636; A63B 1/00; A63B 2210/50; A63B 21/1645; A63B 1/005; Y10S 482/904
USPC ..... 482/38, 39, 40, 37, 41, 96, 131, 143, 482/904
See application file for complete search history.

(56) References Cited

U.S. PATENT DOCUMENTS 3,915,452 A 10/1975 Winblad
4,458,894 A 7/1984 Dudley
(Continued)

FOREIGN PATENT DOCUMENTS

CN 2073316 U 3/1991
CN 2480031 Y 3/2002
(Continued)

OTHER PUBLICATIONS

International Search Report dated Apr. 4, 2012, from PCT/US2011/054925.
(Continued)

*Primary Examiner* — Loan H Thanh
*Assistant Examiner* — Sundhara Ganesan
(74) *Attorney, Agent, or Firm* — Swanson & Bratschun, L.L.C.

(57) ABSTRACT

A portable doorway recreation device for use on a doorway frame comprises an L-shaped frame. A first horizontal elongate bar is attached to a riser of the L-shaped frame and a second horizontal elongate bar is attached to a base of the L-shaped frame. A securing member is operatively associated with the second elongate bar, wherein with the first elongate bar sitting on a top of the doorway frame on a first wall side and the second elongate bar operatively associated with a second wall side, the securing member is configured to engage one of the first and second wall sides to prevent movement of the second elongate bar away from the second wall side.

20 Claims, 30 Drawing Sheets

(51) Int. Cl.

| | |
|---|---|
| ***A63B 21/00*** | (2006.01) |
| ***A63B 21/16*** | (2006.01) |
| ***A63G 9/12*** | (2006.01) |
| *A63B 7/02* | (2006.01) |
| *A63B 69/20* | (2006.01) |
| *A63B 69/24* | (2006.01) |

(52) U.S. Cl.

CPC ..... *A63B 7/02* (2013.01); *A63B 21/00047* (2013.01); *A63B 21/1636* (2013.01); *A63B 2208/0285* (2013.01); *A63B 2210/54* (2013.01); *A63G 9/12* (2013.01); *A63B 69/201* (2013.01); *A63B 69/24* (2013.01); *A63B 1/005* (2013.01)

(56) References Cited

U.S. PATENT DOCUMENTS

| | | | | |
|---|---|---|---|---|
| 4,529,191 | A | 7/1985 | Miller et al. | |
| 4,844,448 | A | 7/1989 | Niznik | |
| 5,180,350 | A | 1/1993 | Thomas | |
| 5,186,696 | A | 2/1993 | Pfefferle | |
| 5,417,628 | A | 5/1995 | Vanderbleek | |
| 5,429,571 | A | 7/1995 | Smith | |
| 5,752,903 | A | 5/1998 | Chang | |
| 5,776,033 | A * | 7/1998 | Brown | 482/40 |
| 6,017,293 | A | 1/2000 | Pfefferle | |
| 6,179,748 | B1 | 1/2001 | Barr | |
| 6,508,743 | B1 | 1/2003 | Fortin | |
| 7,108,636 | B1 | 9/2006 | Garcia | |
| 7,621,847 | B2 | 11/2009 | Lamle et al. | |
| D633,961 | S | 3/2011 | Loew et al. | |
| 8,535,204 | B2 * | 9/2013 | Stacey | 482/40 |
| 2005/0250619 | A1 | 11/2005 | Daikeler et al. | |
| 2012/0129658 | A1 * | 5/2012 | Hunt et al. | 482/38 |
| 2013/0217544 | A1 * | 8/2013 | Anaya | 482/40 |

FOREIGN PATENT DOCUMENTS

| | | |
|---|---|---|
| CN | 200973971 Y | 11/2007 |
| GB | 2243087 | 10/1991 |
| GB | 2299520 | 10/1996 |

OTHER PUBLICATIONS

International Search Report dated Jan. 29, 2013, from PCT/US2012/052335.

Search Report from CN 201180058427.1 dated Aug. 8, 2014.

* cited by examiner

PORTABLE DOORWAY RECREATION APPARATUS

RELATED APPLICATIONS

This application is a 35 U.S.C. §371 national phase application of PCT/US2012/052335, filed Aug. 24, 2012, which is a continuation-in-part application of PCT/US2011/054925 (WO 2012/047999), filed on Oct. 5, 2011, which application claims the benefit of U.S. Provisional Application Ser. No. 61/389,826, filed Oct. 5, 2010, each of which is entitled "Portable Doorway Recreation Apparatus" and each of which is incorporated herein by reference in its entirety.

TECHNICAL FIELD

The present disclosure is directed to a portable doorway recreation apparatus and more particularly to a portable doorway recreation apparatus configured to securely support associated recreation and athletic equipment under vertical, horizontal and combined vertical and horizontal static or dynamic loads.

BACKGROUND

A variety of portable doorway recreation apparatus are known in the art. Commonly these apparatus include generally L-shaped frames having a horizontal support attached to the riser of the L-shaped frame and a horizontal bar (often used as a pull up bar) attached to the base of the L-shaped frame. In use, the horizontal support is brought into contact with the top surface of trim at the top of one side of a doorway and the bar spans the other side of the doorway engaging the trim or wall beyond the vertical edges of the doorway. These apparatus are suitable for use under vertical loads on the horizontal bar such as pull ups where a vertical load on the horizontal bar causes a moment of force in conjunction with the horizontal support which effectively locks the apparatus in place as described above. However, horizontal loads which may be introduced, by way of example, by swinging, can cause the horizontal member to disengage from the top of the door trim, causing the apparatus to fall. Representative devices including this general configuration include Vanderbleek, U.S. Pat. No. 5,417,628 and Winblad, U.S. Pat. No. 3,915,452. Winblad tries to address this problem by providing an adjustable safety lock which includes an L-shaped member slidably mounted to a support spanning the doorway frame opposite the horizontal support. The L-shaped member can be pressed into contact with the underside of the top of the doorway frame and is intended to lock the apparatus in place on the doorway. While this safety lock provides some stability under horizontal loads, it is inadequate under significant or abrupt side to side swinging motion loads such as might be present with a swing or a punching bag mounting to the portable chinning bar assembly of Winblad, or from any athletic exercises involving full-body motion swinging.

The portable doorway recreation apparatus disclosed herein is intended to overcome one or more of the problems discussed above.

SUMMARY OF THE INVENTION

Figure 1:
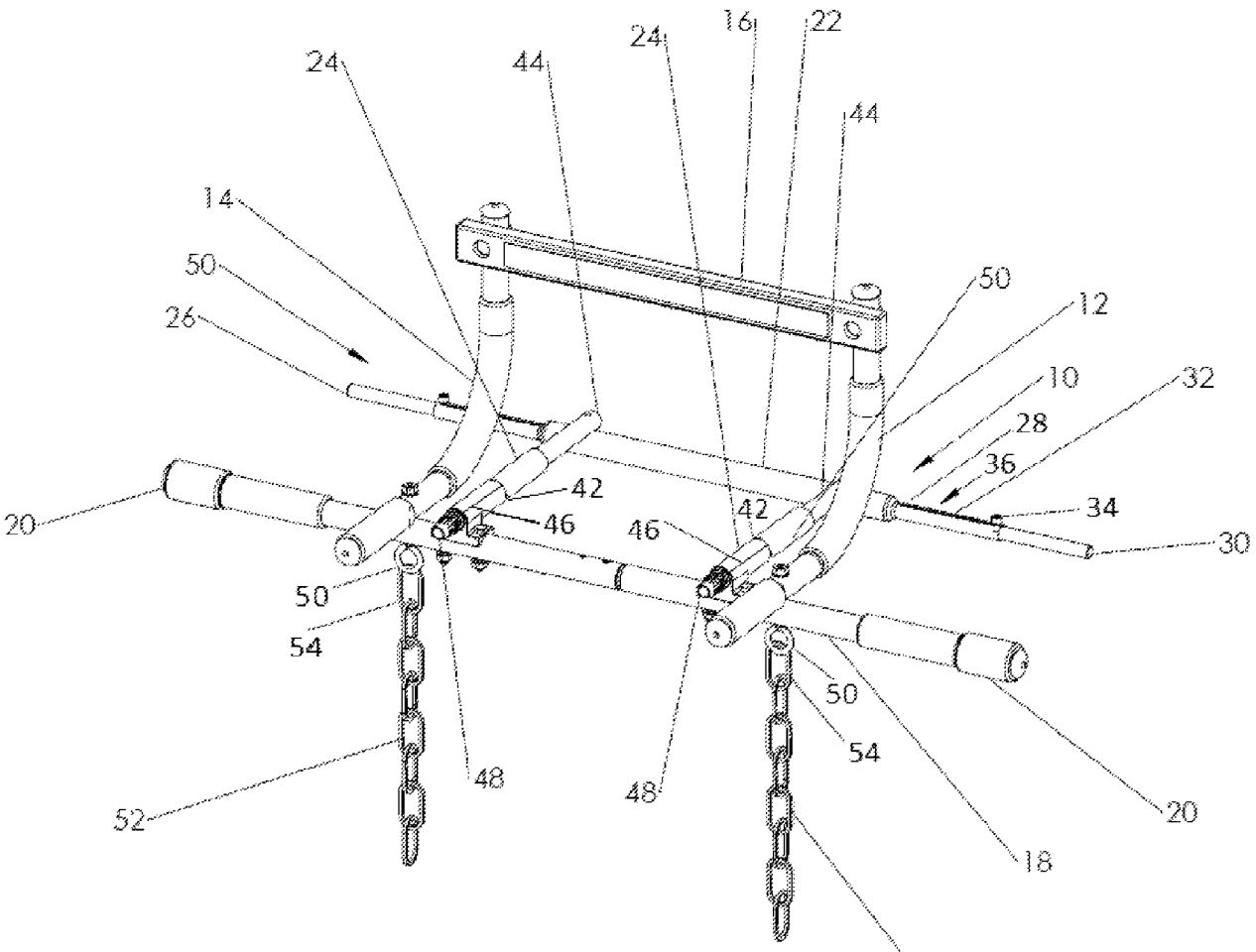
FIG. 1 is a front perspective view of a first embodiment of a portable doorway recreation device for use on a doorway frame.

A portable doorway recreation device for use on a doorway frame comprises an L-shaped frame. A first horizontal elongate bar is attached to a riser of the L-shaped frame and a second horizontal elongate bar is attached to a base of the L-shaped frame. A securing member is operatively associated with the second elongate bar, wherein with the first elongate bar sitting on a top of the doorway frame on a first wall side and the second elongate bar in contact with a second wall side, the securing member is configured to engage one of the first and second wall sides to prevent movement of the second elongate bar away from the second wall side.

In one embodiment, the securing member comprises a locking bar in contact with the first wall side, the elongate bare being attached to the second elongate bar by at least one telescoping strut. The telescoping strut is configured to maintain a select distance between the locking bar and the second elongate bar, the distance being substantially equal to the doorway thickness.

In another embodiment, the securing member comprises a pad pivotably attached to the base of the L-shaped frame configured to contact the second wall side. The securing member may further comprise a strut with one end pivotably attached to the base of the L-shaped frame and a second end attached to the pad. At least one turnbuckle is operatively connected between the base of the L-shaped frame and the strut, whereby tightening the turnbuckle pivots the pad against the second wall side.

In a third embodiment, the securing member comprises a locking bar attached to the base of the L-shaped frame configured to contact the second wall side. The locking bar is configured to contact the second wall side opposite the first horizontal elongate bar. The locking bar further comprises means for applying a squeezing force on a portion of the wall received between the first horizontal elongate bar and locking bar. The squeezing means may comprise a screw operatively associated with a twistable knob. The screw comprises the base of the L-shaped frame and twisting of the knob a first direction moves the locking bar closer to the first elongate bar and twisting of the knob a second direction moves the locking bar away from the first elongate bar.

Another aspect of the invention is a method of attaching a portable doorway recreation device to a doorway frame. The portable doorway recreation device comprises an L-shaped frame, a first horizontal elongate bar attached to the riser of the L-shaped frame and a second horizontal elongate bar attached to the base of the L-shaped frame. A securing member is operatively associated with the second horizontal elongate bar. The method comprises resting the first horizontal elongate bar on top of the doorway frame of a first wall side, abutting the second horizontal elongate bar against a second wall side and forcibly engaging the securing member into contact with one of the first and second wall sides to prevent movement of the second elongate bar away from the second wall side.

DETAILED DESCRIPTION

Unless otherwise indicated, all numbers expressing quantities of ingredients, dimensions reaction conditions and so forth used in the specification and claims are to be understood as being modified in all instances by the term "about".

In this application and the claims, the use of the singular includes the plural unless specifically stated otherwise. In addition, use of "or" means "and/or" unless stated otherwise. Moreover, the use of the term "including", as well as other forms, such as "includes" and "included", is not limiting. Also, terms such as "element" or "component" encompass both elements and components comprising one unit and elements and components that comprise more than one unit unless specifically stated otherwise.

FIG. 1 is a perspective view from the front of a portable doorway recreation apparatus 10 of the present disclosure. The portable doorway recreation apparatus 10 comprises a pair of spaced L-shaped frames 12, 14 having a first elongate bar or support bar 16 spanning the riser portion of the L-shaped frames 12, 14 and attached to distal portions of the L-shaped frames 12, 14. A second elongate bar or pull up bar 18 spans the base portion of the L-shaped frames 12, 14 and is attached thereto. In the embodiment illustrated in FIG. 1, the support bar 16 is attached to an inner portion of the L-shaped frames 12, 14 and the pull up bar 18 is attached to an outer or lower portion of the L-shaped frames 12, 14. Alternatively, the pull up bar 18 could be attached to the inner or upper surface of the L-shaped frames 12, 14. The support bar 16 and the pull up bar 18 can be attached to the L-shaped frames 12, 14 by any suitable means including bolts, screws, clamps, welding, adhesives and any other known means. They could also be integrally formed with the L-shaped frames. The pull up bar 18 is of a length greater than the support bar 16 and the length is chosen so that the pull up bar 18 can span the width of most doorways, as will be described in greater detail below. The ends of the pull up bar 18 include padding 20 to minimize the risk of harming doorway trim when the portable doorway recreation apparatus 10 is disposed on a doorway. Likewise padding could be provided on any other surface of the portable doorway recreation apparatus 10 contacting the doorway or adjacent walls. It may be desirable in that the padding be made of a high coefficient of friction material to help secure the portable doorway recreation apparatus 10. Other embodiments could include only a single L-shaped frame with the bars 16, 18 attached thereto. For example, the bars 16,18 could be attached at or near their midpoints. In an alternative embodiment, the pair of L-shaped frames 12, 14 may be continuously joined to each other, for instance, as a single frame. See FIGS. 18 and 19 for a further description of this embodiment.

The portable doorway recreation apparatus 10 further includes a securing member comprising a locking bar 22 operatively associated with the pull up bar 18. In the embodiment illustrated in FIG. 1, the operative association is provided by a pair of struts 24 which are attached to the pull up bar 18 and extend in the direction toward the riser of the L-shaped frames 12, 14 generally parallel to the base of the L-shaped frames 12, 14, with the locking bar 22 attached near the distal end of the struts. In the embodiment shown in FIG. 1, the locking bar 22 has retractable ends 26. In the illustrated embodiment, the retractable ends 26 are telescoped and biased toward an extended position by an internal spring 28. In the embodiment of FIG. 1, the distal portion 30 of the retractable element is telescopingly received in an intermediate portion 32 which in turn is attached to the main body of the locking bar 22. Alternatively the distal portion 30 could be telescopingly received in the in the main body of the locking bar directly. A locking screw 34 is received in the axial slot 36 of the intermediate portion and threadably engages a proximal end of the distal portion. With the locking screw 34 tightened the distal portion 30 is axially fixed. However, with the locking screw 34 loosened, the distal portion 30 can telescope in and out axially of the intermediate portion 32, but, as described above, is biased outward by the spring 28.

The struts 24 are operatively associated with the pull up bar 18, allowing the locking bar 22 to be spaced a selected distance horizontally from the pull up bar 18. Various means for allowing the locking bar 22 to be spaced a select distance are within the scope of the invention. In the embodiment illustrated in FIG. 1, the particular means comprises the strut 24 comprising a sleeve 42 telescopingly receiving post 44. An axial screw 46 within the sleeve 42 has a proximal end attached to a knob 48 and a distal end threadably received in the proximal end of the bar 44. This allows the horizontal distance between the locking bar 22 and the pull up bar 18 to be selectively varied by turning the knobs 48. As one alternative means for varying the horizontal distance, the strut could be simply be a bar and a clamp could be provided on one or both of the pull up bar or locking bar to selectively axially clamp or release the strut 24. In another alternative embodiment, the second elongate bar or pull up bar 18 may be operatively associated with a securing member comprising clamps on either end of the bar 18. See FIGS. 18-26 for a detailed description of this embodiment.

Figure 5:
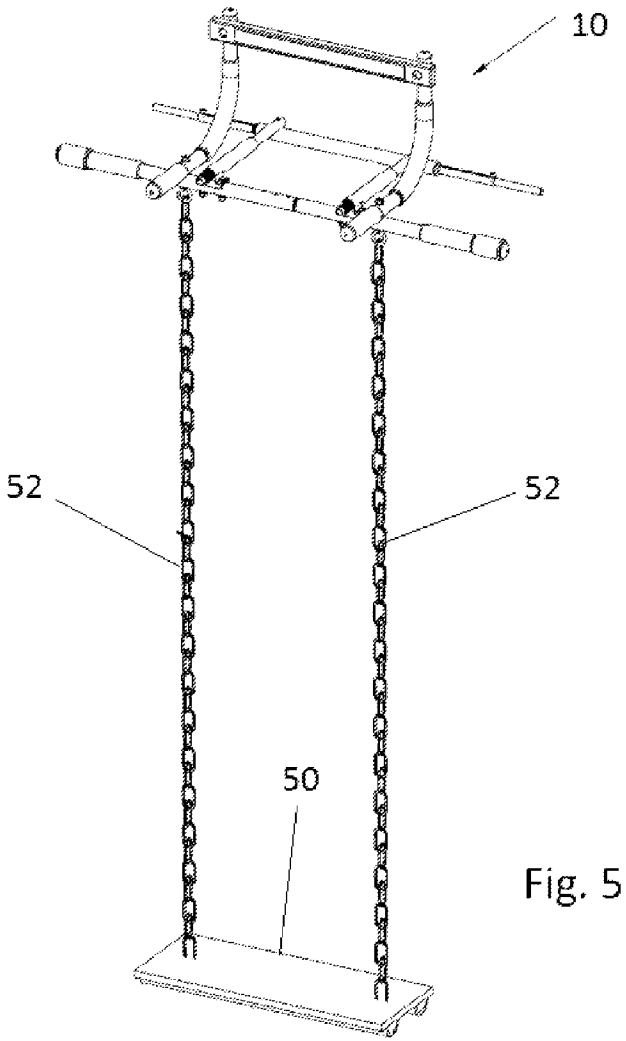
FIG. 5 is a perspective view of the portable doorway recreation device of FIG. 1 with a swing suspended therefrom.

The materials comprising the portable doorway recreation apparatus 10 are chosen to bear the various loads when the portable doorway recreation apparatus 10 is in use. Various uses might include as a chin-up bar, as support for a child's toy such as a swing, as depicted in FIG. 5, as a support for a punching bag or even a support for a sex apparatus. In one embodiment the pull up bar 18, the locking bar 22 and the L-shaped frames 12, 14 are made of suitably rigid metal such as steel. Other suitable materials would include various composites such as carbon fiber. The first bar or support bar 16 can also be made of such a suitable material or may be made of a suitably rigid plastic for the purpose of minimizing possible harm to the doorway trim.

In the embodiment shown in FIG. 1, the struts 48 are attached to the pull up bar 18. Alternatively, the struts 24 could be attached to the base of the L-shaped frames 12, 14.

In an embodiment not illustrated herein, the distal ends of the riser portion of the L-shaped frames 12, 14 could be telescopingly received in a proximal portion so that the effective length of the riser portion of the L-shaped frames 12, 14 could be varied to accommodate trims of different height or for user preference. Similarly, the distal portion of the base of the L-shaped frames 12, 14 could be telescopingly received in the main body of the L-shaped frames 12, 14 to allow for variation of the length of the base portion of the L-shaped frames 12, 14. Such an embodiment would be useful for accommodating doorways in walls of varying thickness. Other manners of varying the length of the L-shaped frame risers or base are considered within the scope of the invention.

In the embodiment illustrated in FIG. 1, eyelets 50 are attached to the pull up bar 18 and depend downward. These eyelets 50 can be used for attaching chains 52 by means of carabineers 54 as shown in FIG. 1. Various recreational devices such as swings, punching bags or the like can be suspended from the chains 52.

Figure 2:
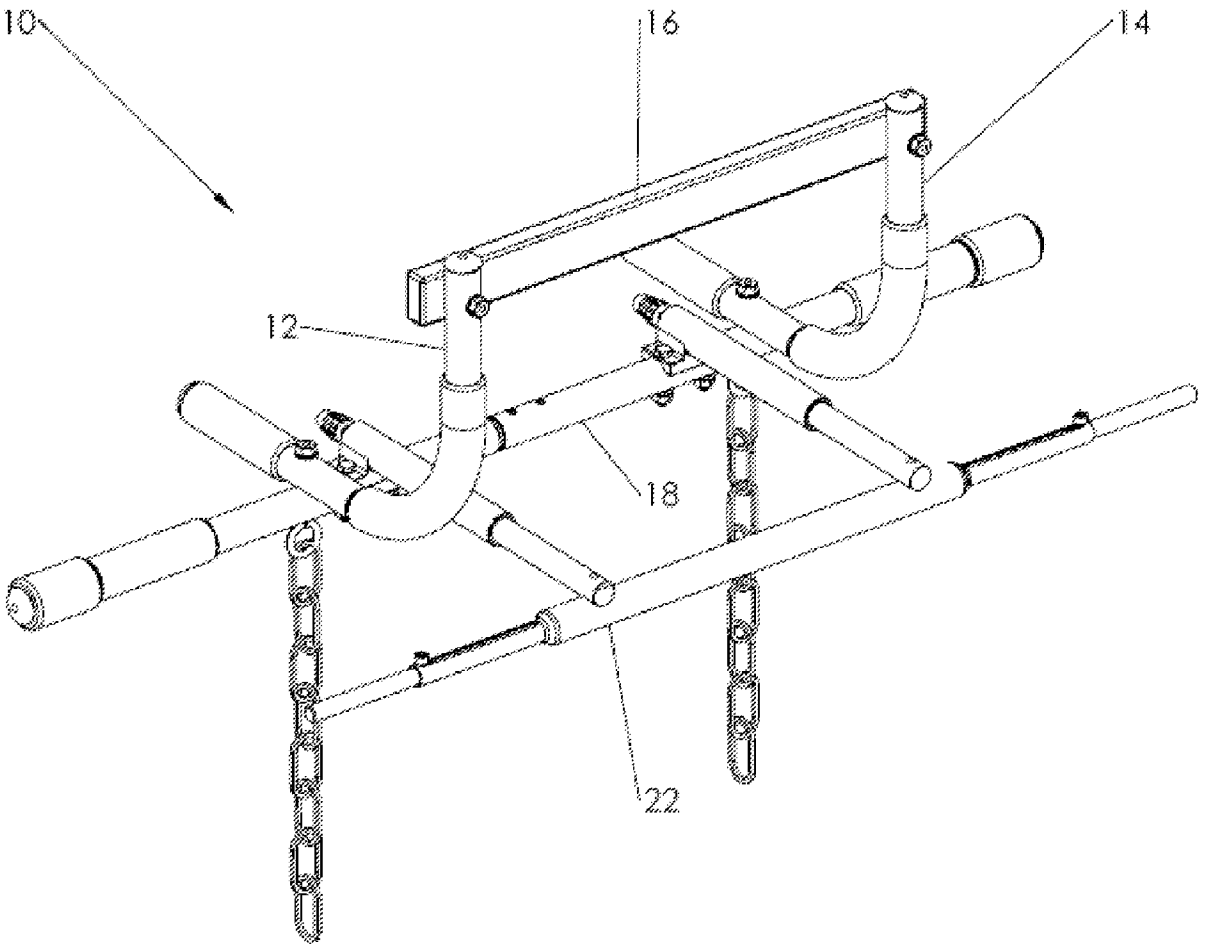
FIG. 2 is a rear perspective view of the portable doorway recreation device of FIG. 1.

FIG. 2 depicts the portable doorway recreation apparatus 10 from the back and is otherwise identical to the embodiment illustrated in FIG. 1.

Figure 3:
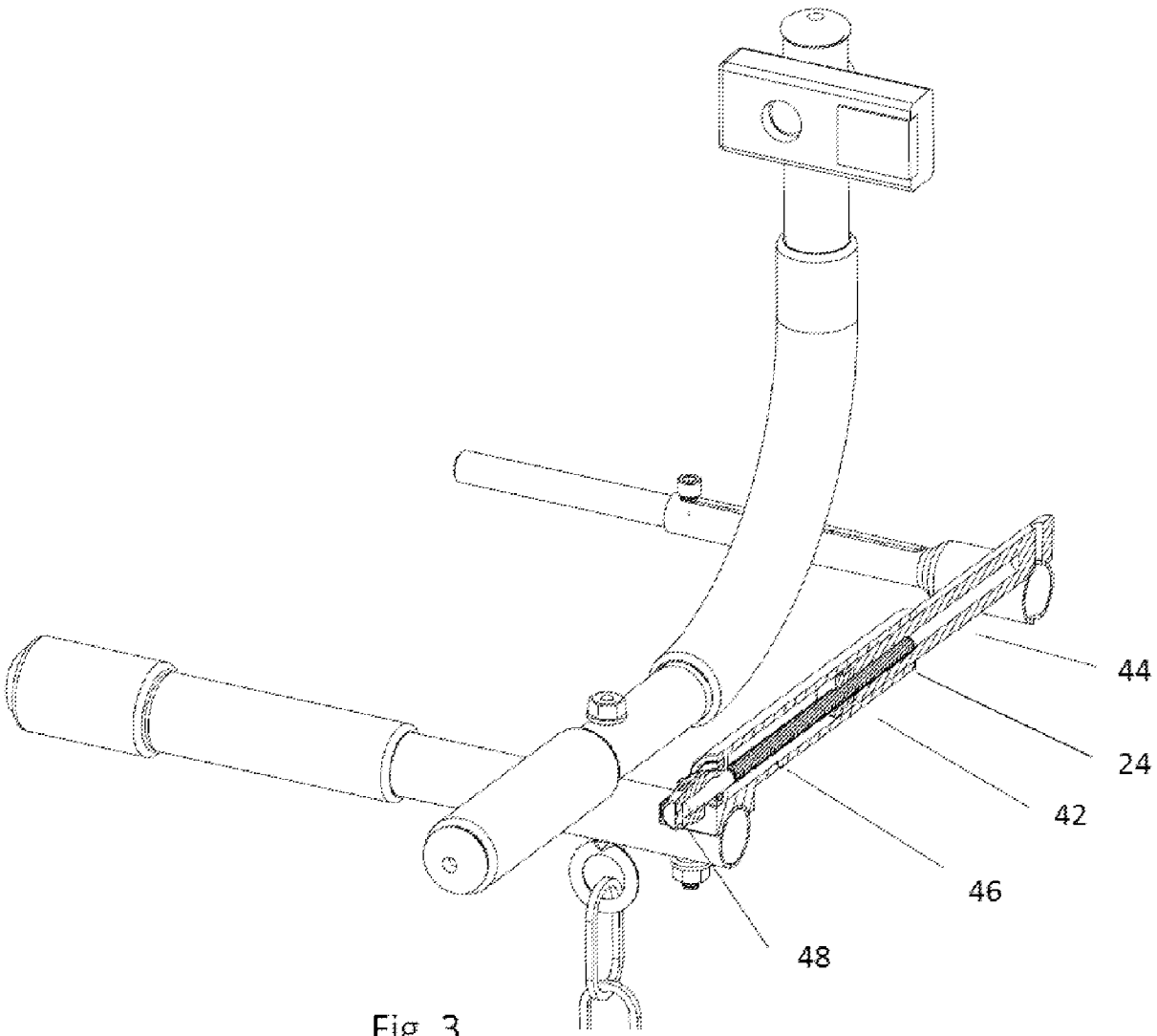
FIG. 3 is an enlarged perspective view of a strut connecting a locking bar to a second elongate bar of the doorway frame of FIG. 1.

FIG. 3 is an enlarged perspective view of the strut 24.

Figure 4:
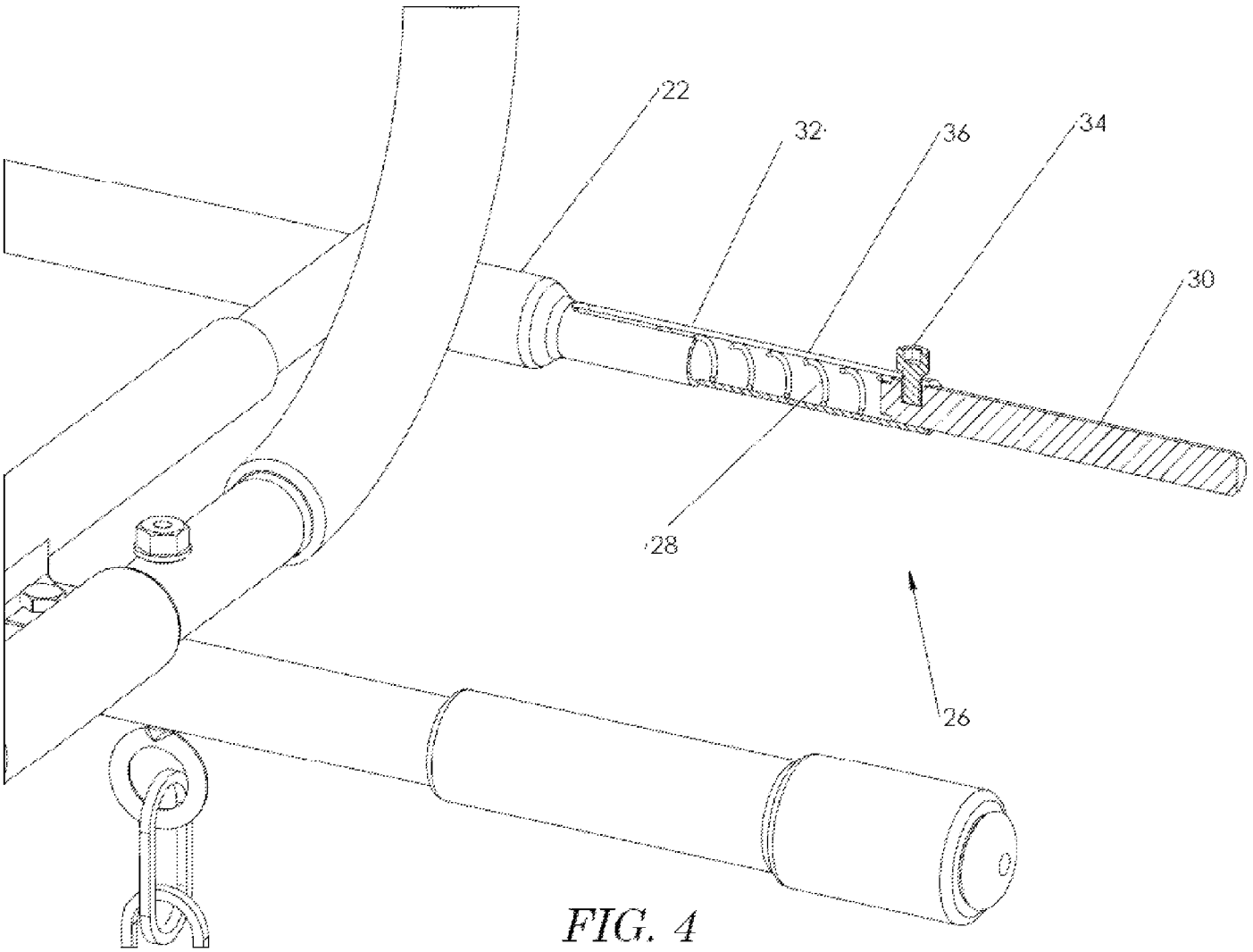
FIG. 4 is an enlarged perspective view of a distal end of the locking bar of FIG. 1.

FIG. 4 is an enlarged perspective view showing the retractable end 26 of the locking bar 22.

FIG. 5 illustrates the portable doorway recreation apparatus 10 with a swing 60 attached thereto by the chains 52.

Figure 6:
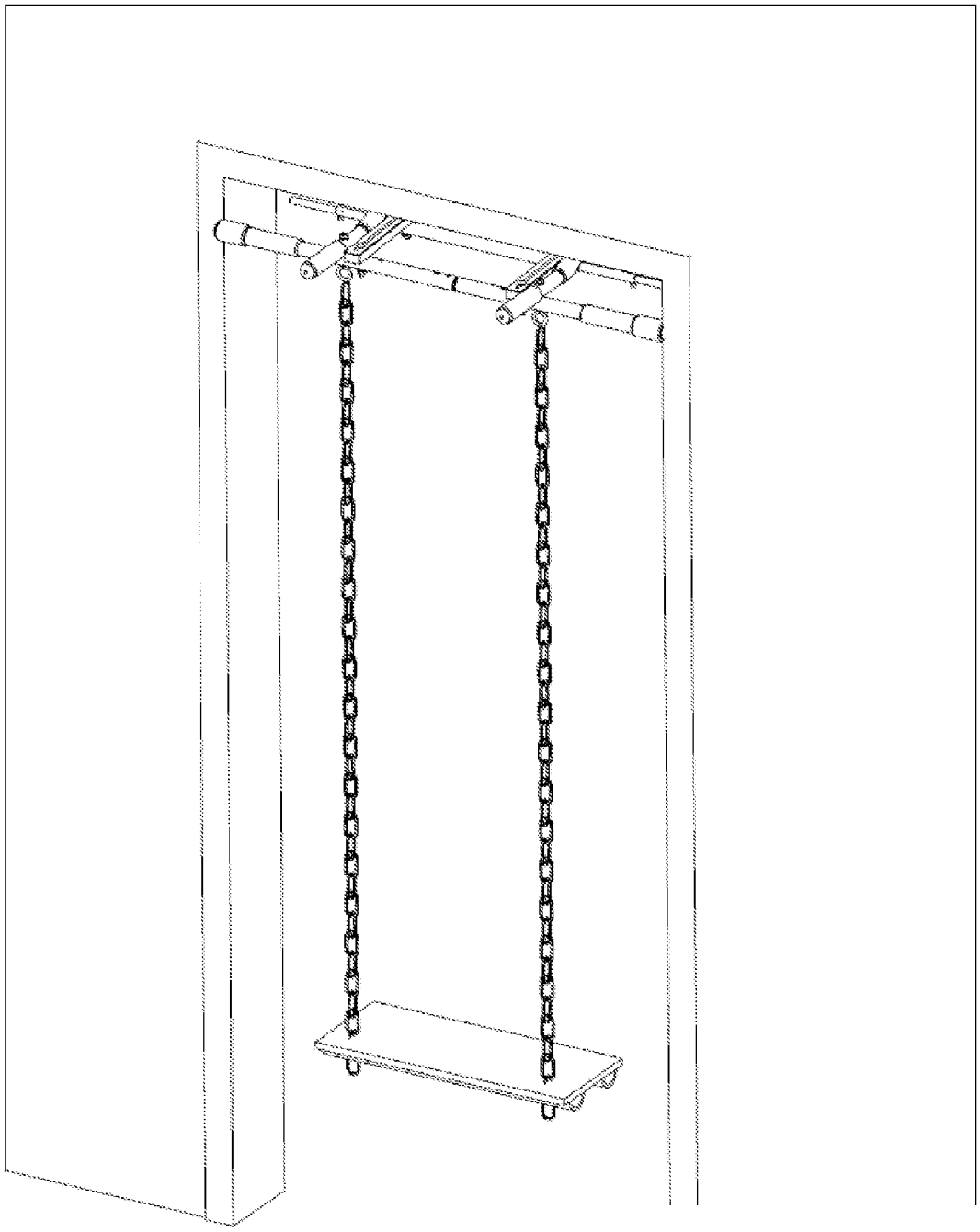
FIG. 6 is a front perspective view of the portable doorway recreation device of FIG. 1 attached to a doorway frame with a swing suspended therefrom.

FIG. 6 is a front view of the portable doorway recreation apparatus 10 installed on a doorway. FIG. 6 illustrates the second elongate bar or pull up bar 18 spanning with the width of the doorway.

Figure 7:
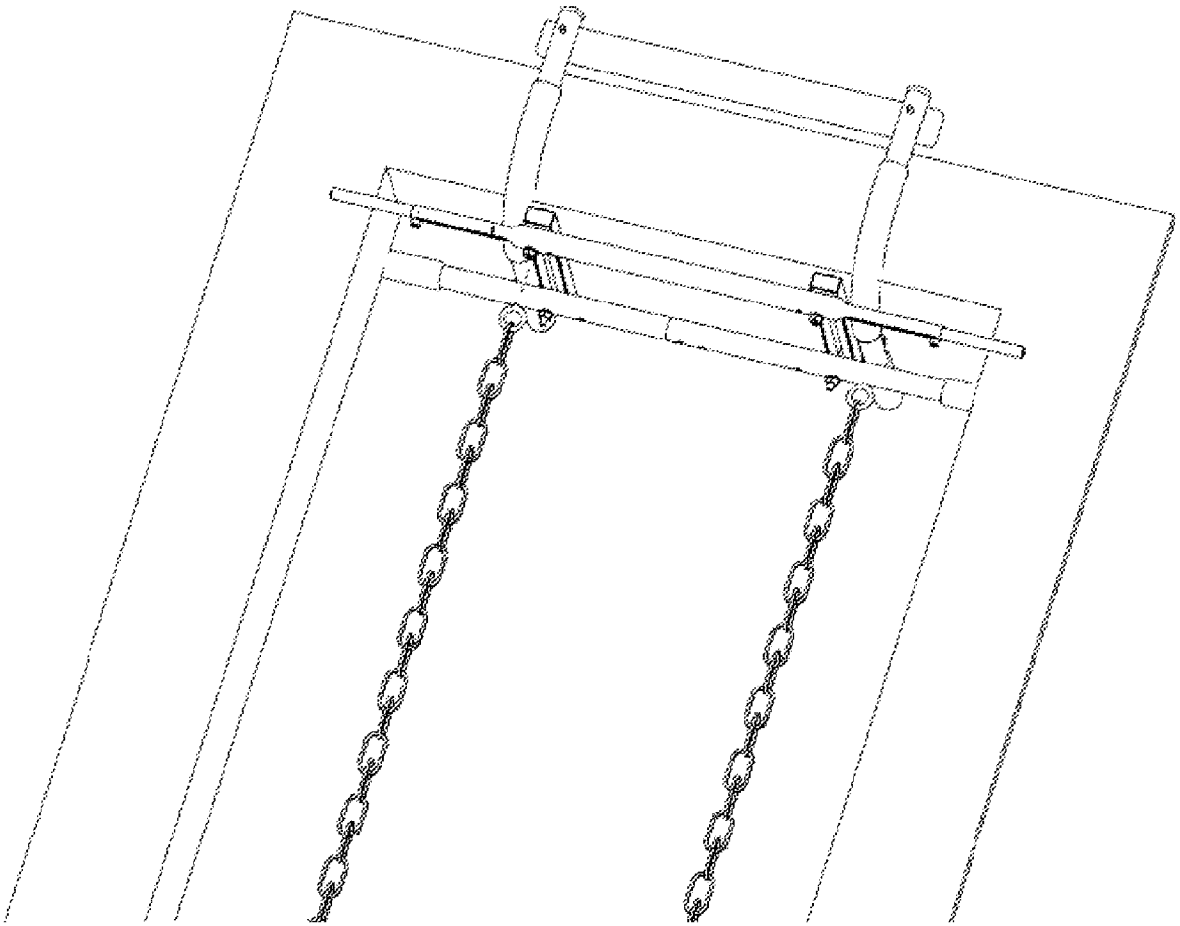
FIG. 7 is a rear bottom perspective view of the portable doorway recreation device of FIG. 1 attached to a doorway frame.

FIG. 7 is a rear view of the portable doorway recreation apparatus 10 attached to a doorway. In this figure the support bar 16 is shown engaging a top surface of the door trim and the locking bar 22 is shown spanning the open doorway and engaging the trim adjacent to the doorway opening. As depicted in FIG. 7, the horizontal distance between the pull up bar 18 and the locking bar 22 is approximately equal to the distance between the front and back of the trim on opposing sides of the wall and the wall is thus received therebetween. When attached in this matter, the portable doorway recreation apparatus 10 is securely mounted and can bear both vertical and varying horizontal forces without releasing from the doorway.

Referring to FIG. 7, the portable doorway recreation apparatus 10 is installed by first compressing the retractable ends 26 of the locking bar 22 to allow placement on the opposite side of the doorway from the pull up bar 18 and then resting the first bar or support bar 16 on top of the trim on the same side of the doorway as the locking bar. The retractable ends 26 can then be released. The struts 24 are then adjusted using the knobs 48 to snuggly receive the doorframe between the locking bar 22 and the pull up bar 18.

Often a doorway will include vertical ribs on the doorway edges intended to abut or stop a closed door. Under these circumstances, the retractable ends 26 can be retraced so that the locking bar 22 has a length about equal to the length of the doorway. The struts 24 can be adjusted to draw the locking bar 22 toward the pull up bar 18 so that the retractable ends abut the doorway rib and thereby secure the portable doorway recreation apparatus 10 in place. The retractable ends 26 may be padded by a high coefficient of friction material to protect the doorway and help secure the locking bar 22. In some embodiments, a clamp, such as a vice clamp secured to the second elongate bar or pull up bar 18, can engage the vertical rib on the doorway edges. See FIGS. 18-26 for further detailed description.

Figure 8:
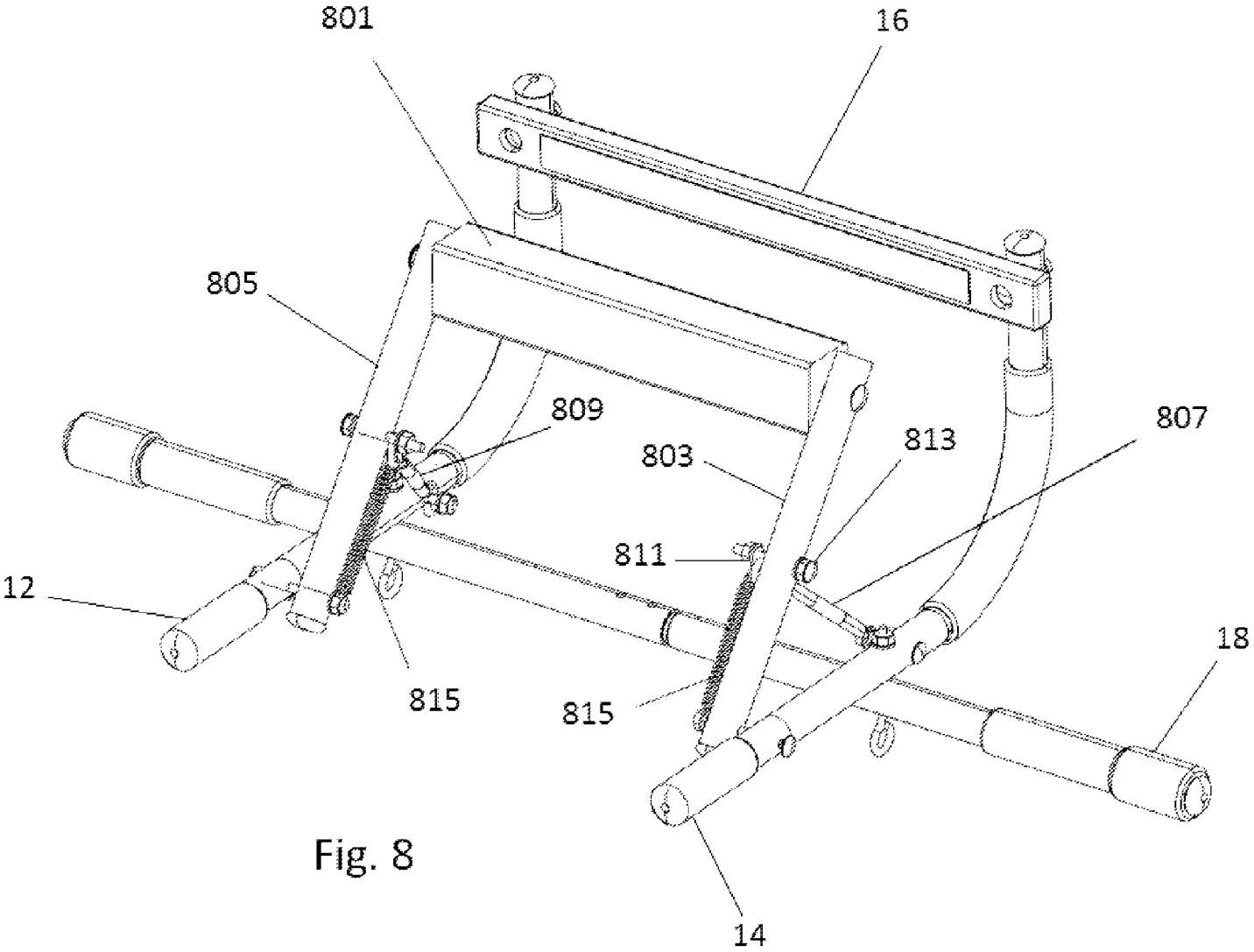
FIG. 8 is a side perspective view of a second embodiment of a portable doorway recreation device.
Figure 9:
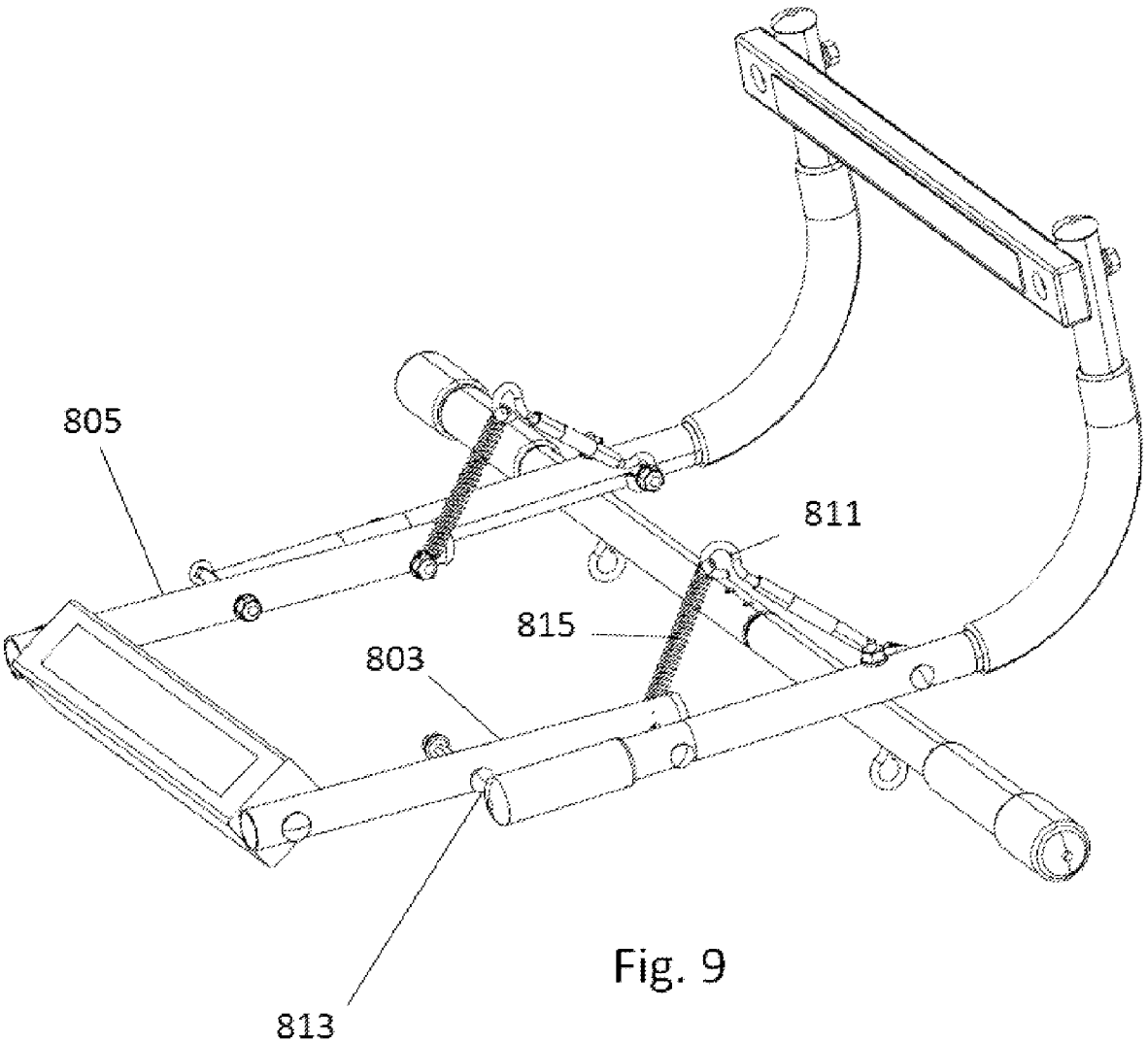
FIG. 9 is a side perspective view of the portable doorway recreation device of FIG. 8 with the turnbuckles released from struts supporting the securing member.

FIG. 8 shows a second embodiment of the portable doorway recreation device. The two L-shaped bars 12,14 are spaced apart with the first elongate bar 16 attached to the risers of the L-shaped bars and the second elongate bar 18 attached to the base of the L-shaped bars. A securing member comprises a rectangular pad 801 attached to the base of the L-shaped bars 12, 14 by struts 803,805. More particularly, a first end of each strut 803,805 is pivotably mounted to the base of the L-shaped bar distal of the second elongate bar 18 and the rectangular pad 801 is pivotably attached at opposite ends to the second ends of the struts 803,805. A turnbuckle 807,809 joins each strut to the base of the L-shaped bar proximate the second elongate bar 18. In one embodiment a first end of the turnbuckle is pivotably attached proximate the second elongate bar 18 and the second end of the turnbuckle comprises an eyelet 811 which can selectively receive the post 813 on the struts 803,805. A spring 815 may optionally be provided to help maintain the turnbuckle in place. FIG. 9 shows a close-up of this structure.

When mounted on the doorway, the securing means for this device is provided with the rectangular pad 801 that is aligned against the second side of the wall. The turnbuckles at 807, 809 provide a pivoting force when tightened to keep the rectangular pad 801 against the second side of the wall. The rectangular pad 801 presses toward the first elongate bar 16 on the first side of the wall, applying a force to the second elongate bar 18 keeping the second elongate bar 18 flush against the second side of the doorway beneath the rectangular pad 801. The second elongate bar 18 could be a pull-up bar.

Figure 10:
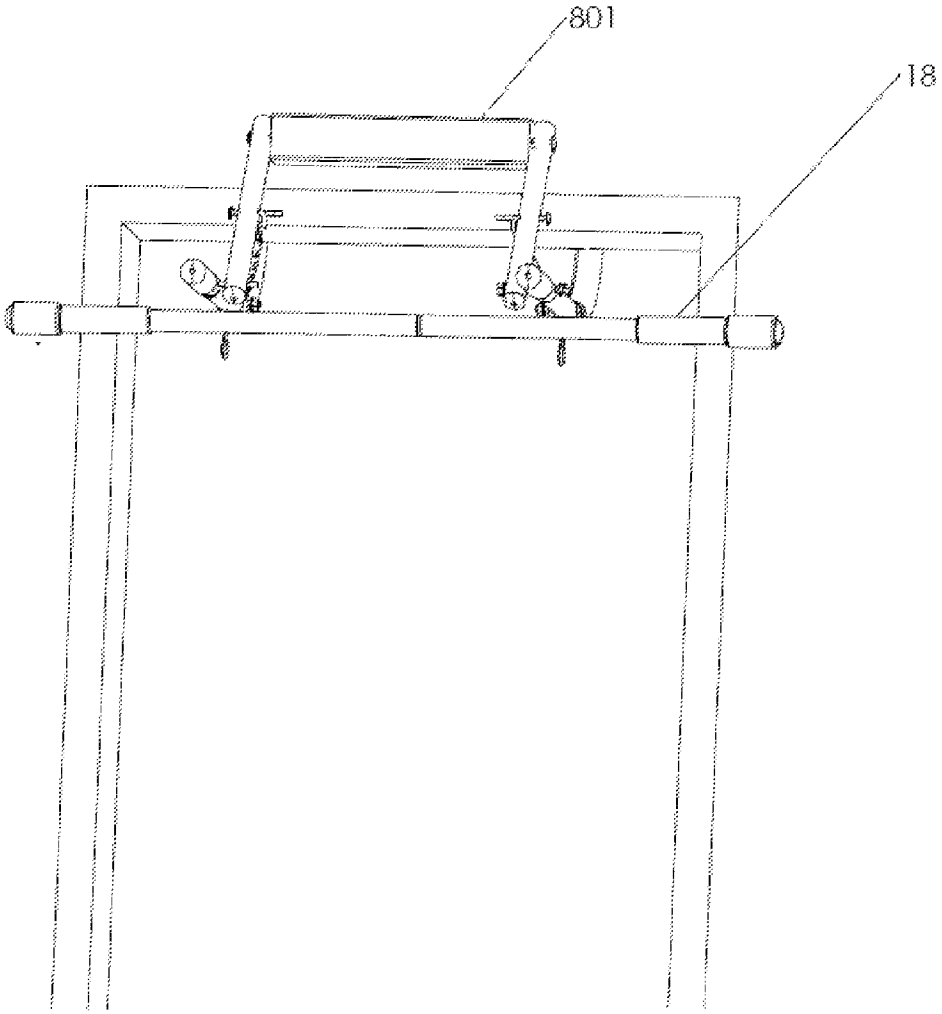
FIG. 10 is a front, bottom perspective view of the second embodiment of a portable doorway recreation device of FIG. 8 shown mounted to a doorway.

FIG. 10 shows the second embodiment of the portable doorway recreation device deployed correctly in a doorway from the second wall side. The rectangular pad 801 and second elongate bar 18 are shown mounted against the second wall side. The first elongate bar is hidden from view on the first wall side.

Figure 11:
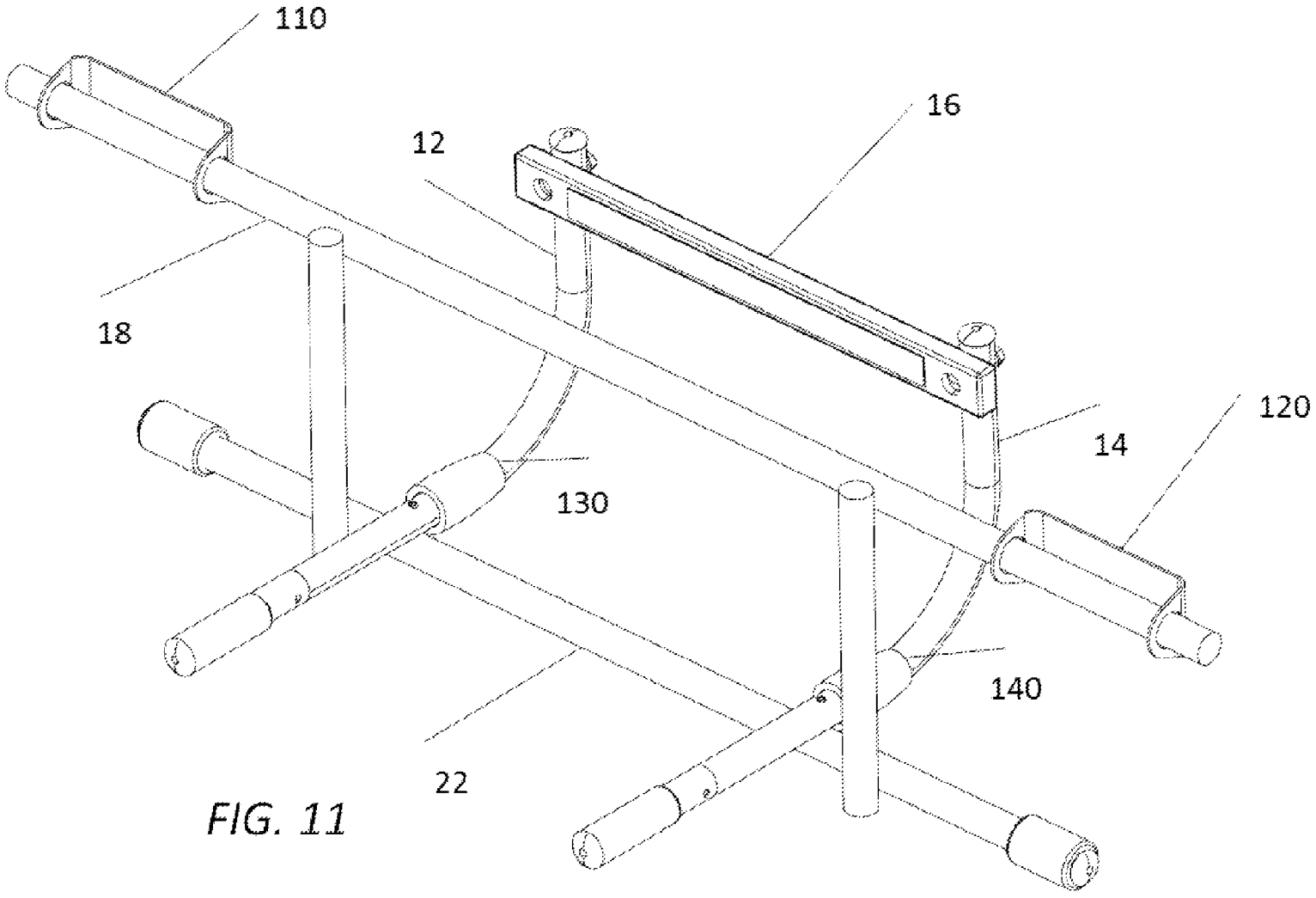
FIG. 11 is a front perspective view of a third embodiment of a portable doorway recreation device.

FIG. 11 shows a third embodiment of the portable doorway recreation device. The two L-shaped bars 12, 14 are spaced apart with the first elongate bar 16 attached to the risers of the L-shaped bar. The second elongate bar 18 is attached to the base of the L-shaped bar. A protruding pad 110,120 is secured at each end of locking bar 22, with the protrusion and padded side oriented facing the direction of the first elongate bar 16. The locking bar is joined to the second elongate bar 18 by vertical struts. A twistable knob 130,140 is attached to the base of each L-shaped bar 12, 14 proximate the second elongate bar 18. The twistable knob 130,140 may be operatively associated with a screw such that twisting the knob a first direction tightens the screw and twisting the knob a second direction loosens the screw. The internal structure may be similar to the telescoping strut of the first embodiment discussed above or as described below with respect to FIG. 17. The twisting knob 130,140, and the screw, are operatively associated with the locking bar 22 such that twisting the knob 130,140 brings the locking bar 22 closer to or further from the riser of the L-shaped bar and the first elongate bar 16.

The protruding pads 110, 120 at each end of the locking bar 22 are forced against second wall side by turning the adjustable knobs 130,140. The adjustable knobs 130,140 may be turned to tighten or loosen the screws inside the knobs. Tightening the knobs would squeeze the locking bar 22 and protruding pads 110,120 toward the first elongate bar 16. This squeezing pressure mounts the portable doorway recreation device in place by moving the second elongate bar 18 and the locking bar 22 closer the first elongate bar 16.

Figure 12:
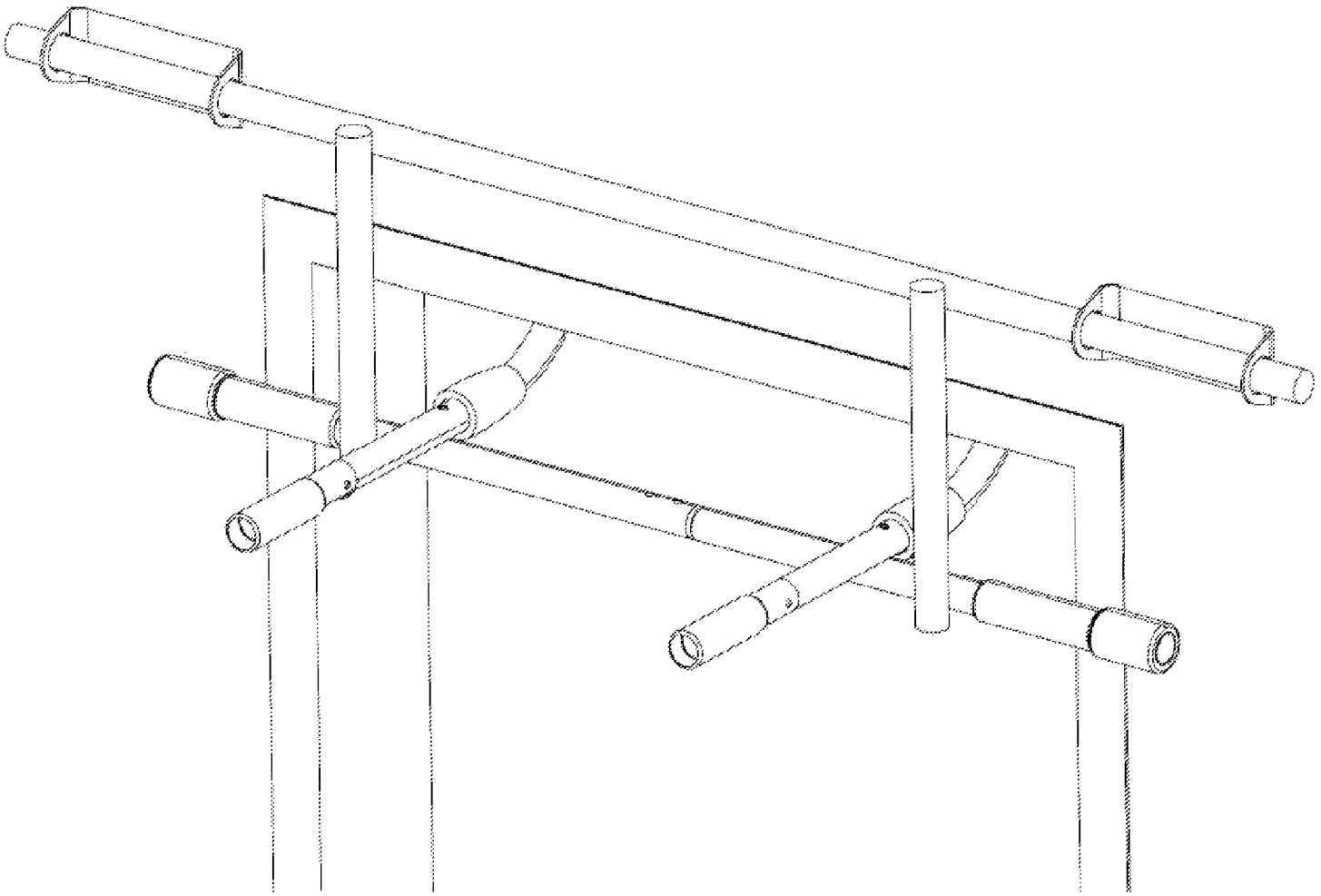
FIG. 12 is a front perspective view of the third embodiment of a portable doorway recreation device of FIG. 11 mounted to a doorway.

FIG. 12 shows the third embodiment properly deployed in a doorway from view of the second wall side. The first elongate bar is hidden from view.

Figure 13:
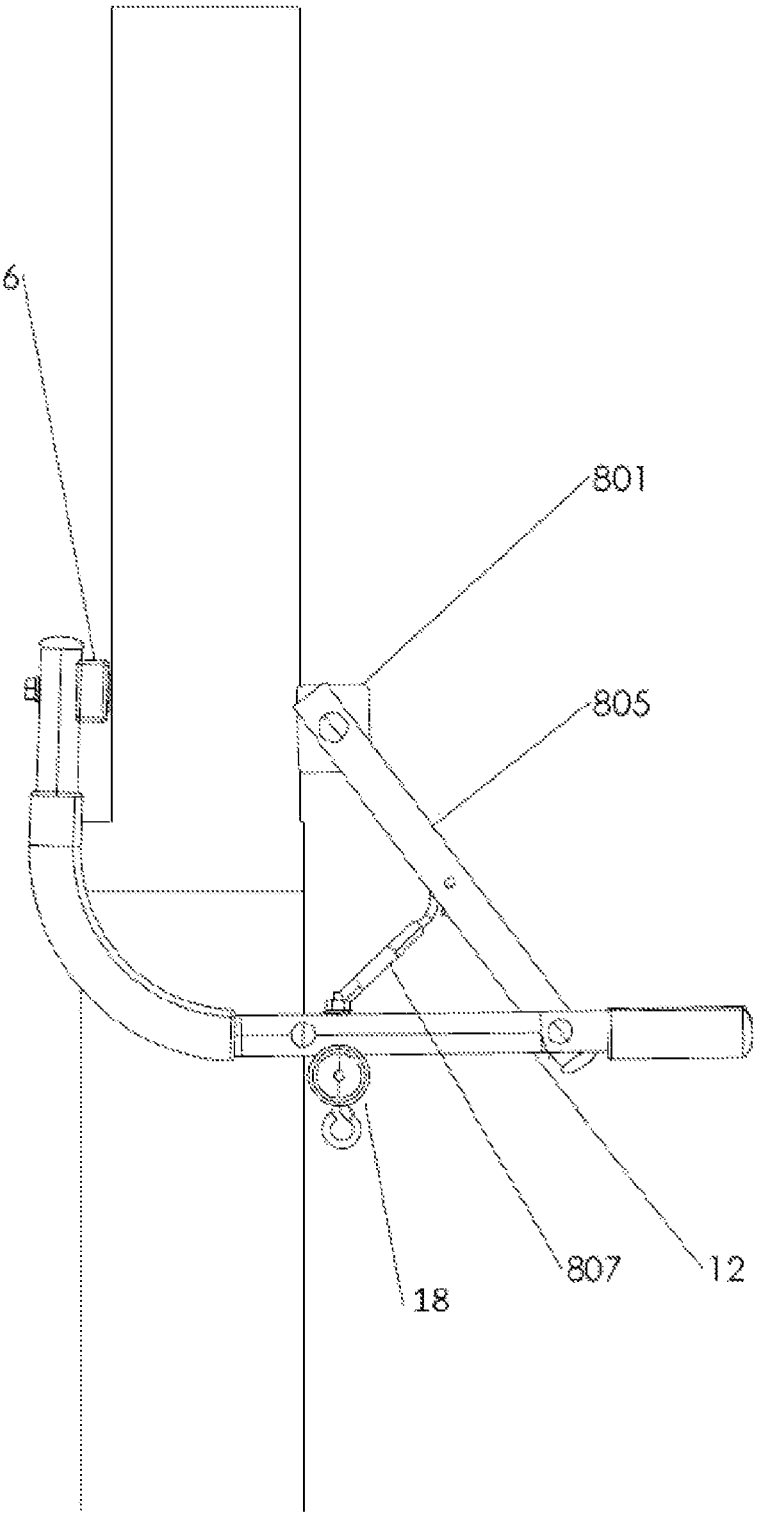
FIG. 13 is a side elevation view of the second embodiment of a portable doorway recreation device of FIG. 8.

FIG. 13 shows a detailed side elevation of the second embodiment mounted on a doorway frame. The L-shaped bar 12 is attached to a first elongate bar 16 is shown on a first wall side. As deployed, the first elongate bar 16 hooks on top of the doorway frame. The second elongate bar 18 abuts the second side of the wall on opposite sides of the doorway. The rectangular pad 801 connected to the struts 805 is pivoted toward the second wall side by a turnbuckle 807.

Figure 14:
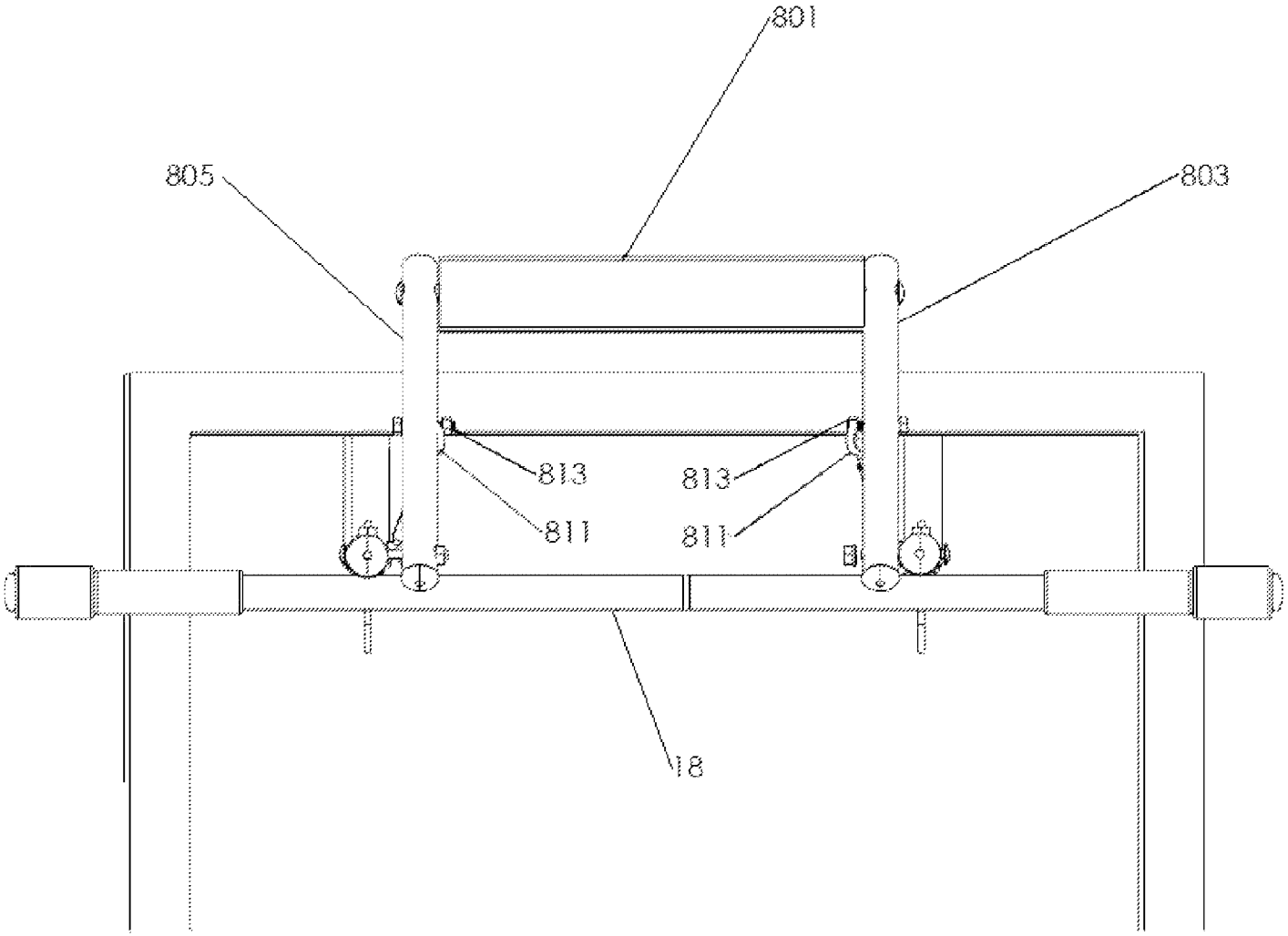
FIG. 14 is a front elevation view of the second embodiment of a portable doorway recreation device of FIG. 8 attached to a doorway.

FIG. 14 shows a detailed front elevation of the second embodiment. The rectangular pad 801 is held by struts 803, 805. On each strut, an eyelet 813 and hook 811 of the turnbuckle assembly (hidden) maintain the elevated position of the struts 803, 805 and rectangular pad 801 above the doorway. The second elongate bar 18 is flush against the doorway frame and supported by the structure.

Figure 15:
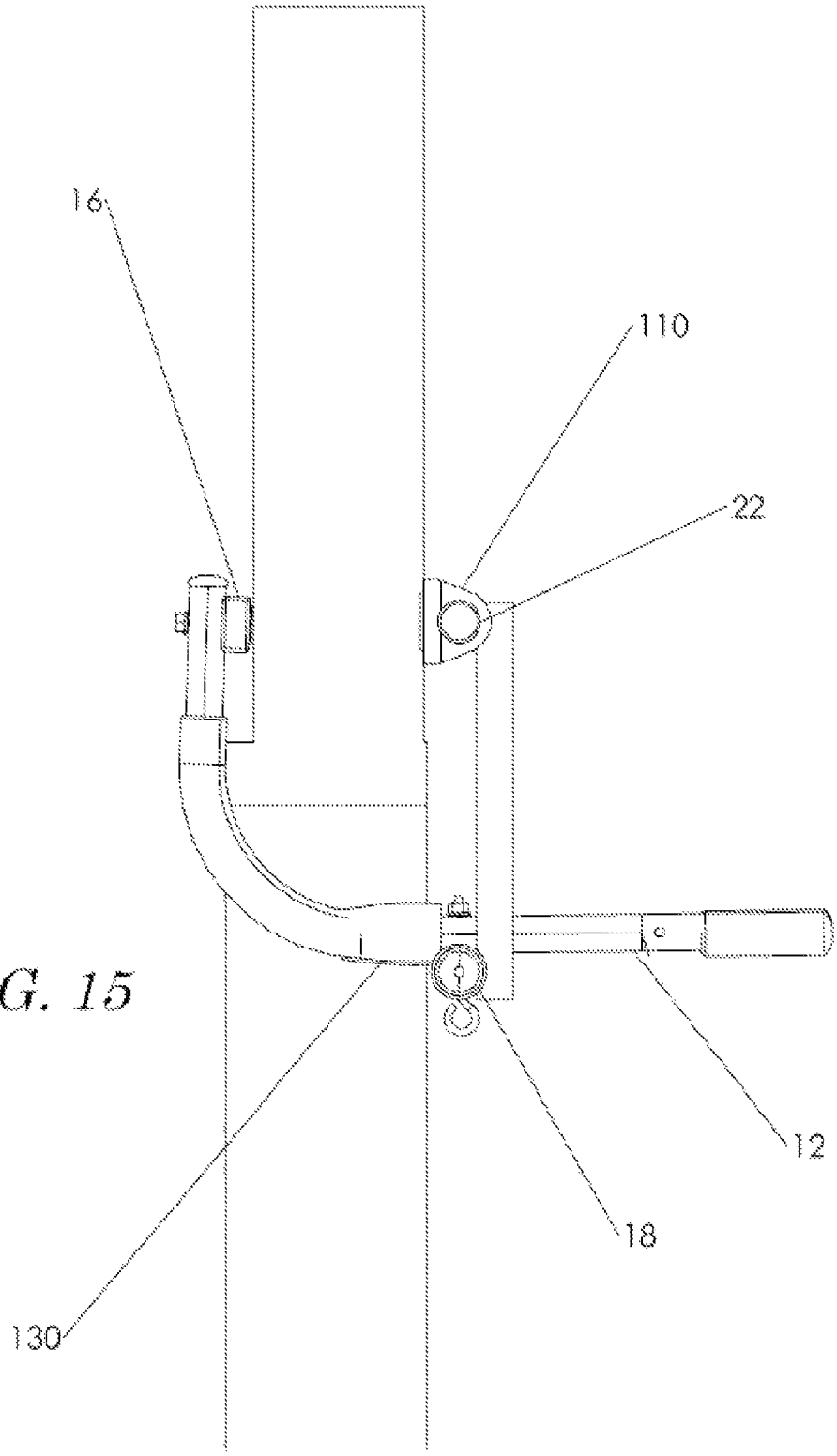
FIG. 15 is a side elevation view of the third embodiment of a portable doorway recreation device of FIG. 11.

FIG. 15 shows a detailed side elevation of the third embodiment mounted on a doorway frame. On a first wall side, the first horizontal bar 16 rests on top of the doorway frame. The locking bar 22 is attached to the rectangular pad 110, abutting the second side wall. The pads attached to the locking bar 22 are also maintained flush to the second wall by action of the twisting knob 130 that is operatively attached to the L-shaped frame 12.

Figure 16:
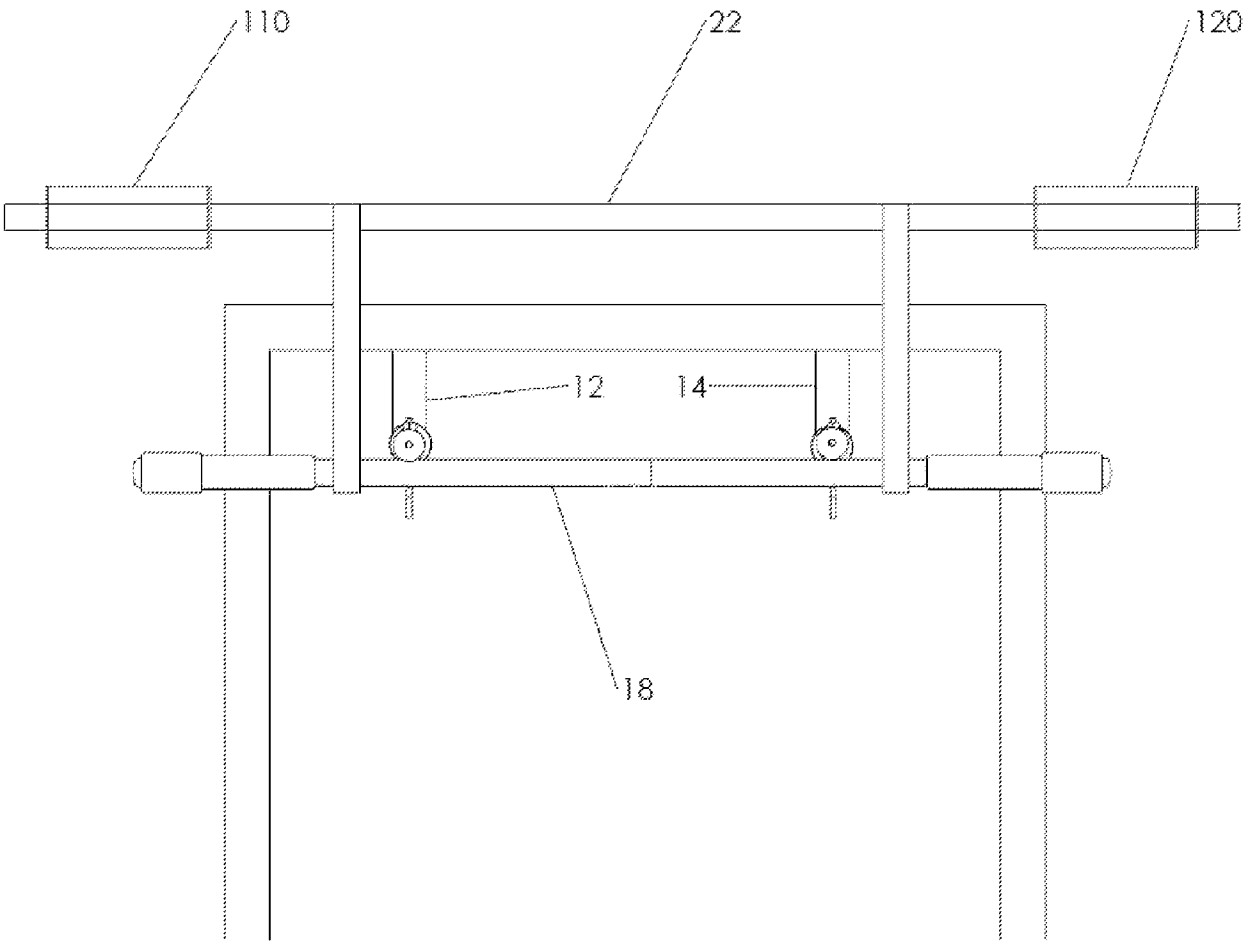
FIG. 16 is a front elevation view of the third embodiment of a portable doorway recreation device of FIG. 11 mounted to a doorway.

FIG. 16 shows a detailed front elevation of the third embodiment mounted on the doorway from a second wall side. The two protruding pads 110,120 are spaced apart along the locking bar 22. The second elongate bar spans the doorway opening and attaches to base ends of the L-shaped frames 12, 14.

Figure 17:
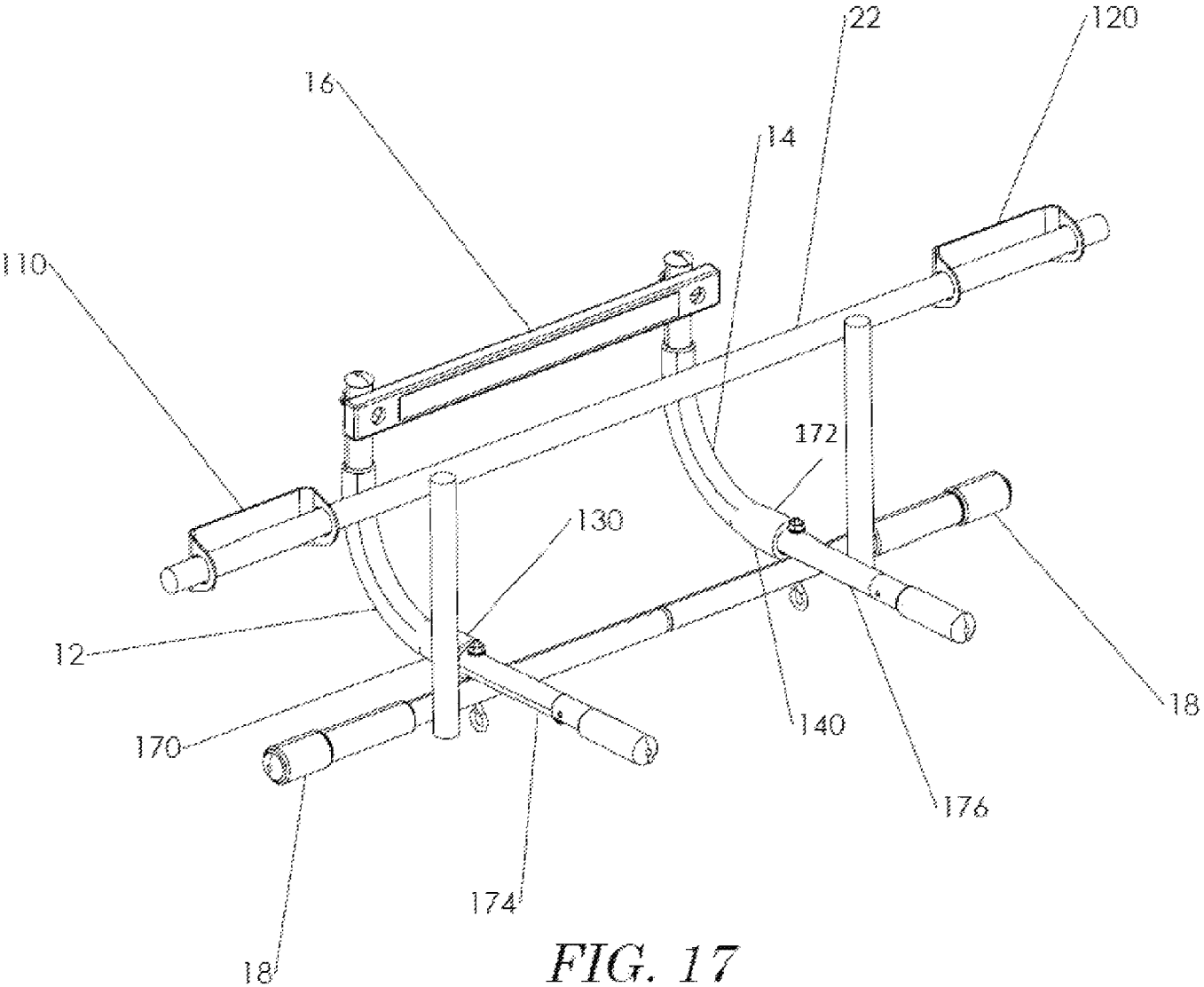
FIG. 17 is a front perspective view of the third embodiment of a portable doorway recreation device of FIG. 11.

FIG. 17 shows front perspective view of the components of the third embodiment. The protruding pads 110,120 receive the ends of the locking bar 22. The first elongate bar 16 attaches to the riser of the L-shaped frames 12, 14. At a base of the riser portion of the L-shaped frames 12, 14 are threaded ends 170,172 which may be received in one end of the twistable knobs 130,140. The base of the L-shaped frames 12, 14 are similarly threaded to be received on the remaining end of the twistable knob 130,140. The knob 130,140 and L-shaped frame 12, 14 assembly operate as screws, wherein twisting the twistable knob 130,140 one direction may bring the base portion of the L-shaped frame 12, 14 closer to the riser portion of the L-shaped frame 12, 14. The squeezing force provided by the screw setup also allows the device to be compatible for different wall thicknesses.

Figure 18:
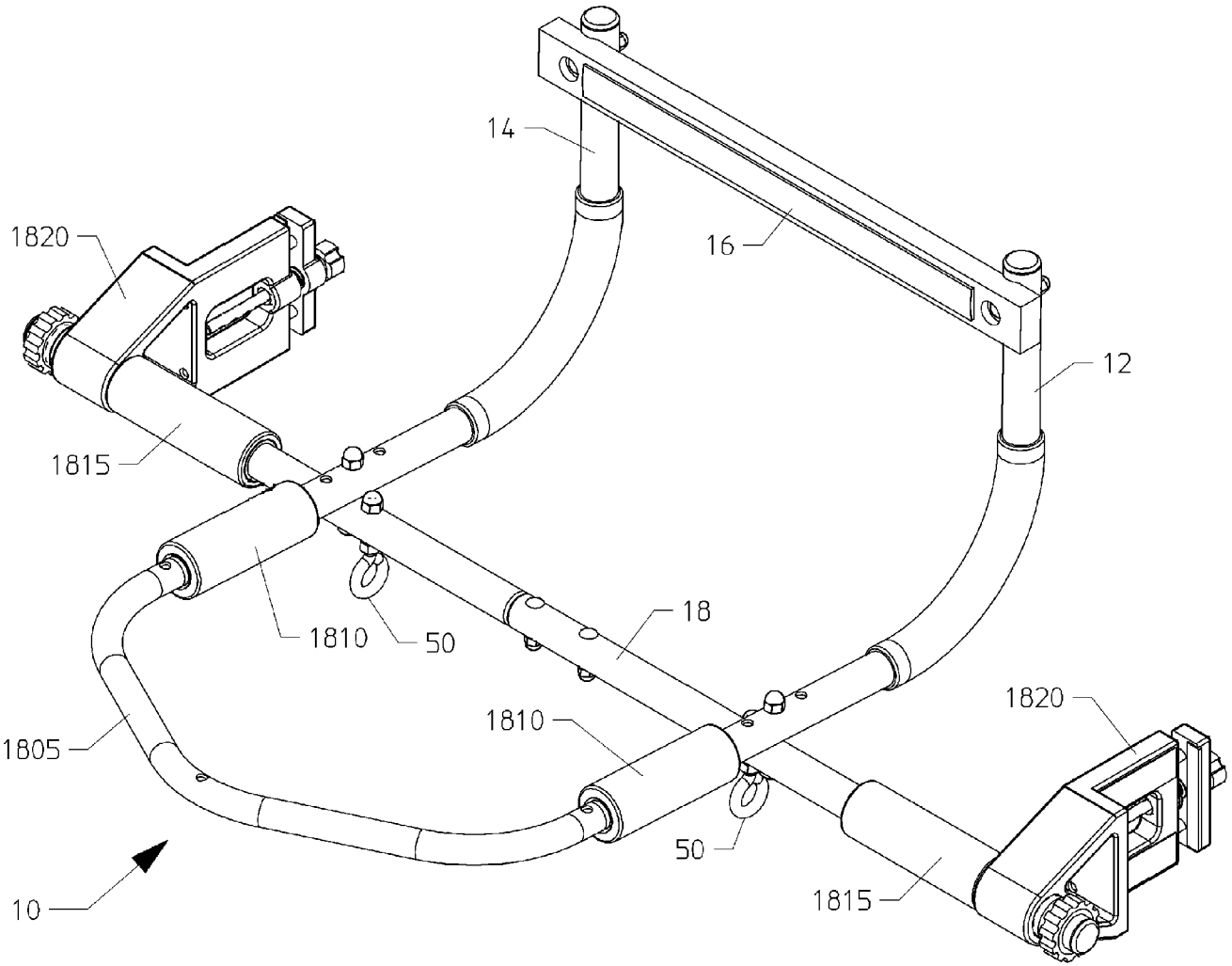
FIG. 18 is a perspective view of an alternative embodiment of the portable doorway recreation apparatus of FIG. 1.

FIG. 18 shows a perspective view of an alternative embodiment of the portable doorway recreation apparatus 10 of the present disclosure. The pair of L-shaped frames 12, 14, are connected to a first elongate bar or support bar 16 spanning the riser portion of the L-shaped frames 12, 14. The second elongate bar or pull up bar 18 spans the base portion of the L-shaped frames 12, 14, and is attached from underside the L-shaped frames 12, 14, as shown. Alternatively, the second elongate bar or pull up bar 18 could be attached to an upper surface of the L-shaped frames 12, 14. Attachment methods might consist of, merely by way of example, nuts, bolts, screws, and other methods known in the art applicable to joining the L-shaped frames 12, 14, first elongate bar or support bar 16, and the second elongate bar or pull up bar 18. The second elongate bar or pull up bar 18 is further attached to a pair of rubber pull up grips 1815. Each end of the pull up bar 18 is further received by a pair of vice clamps 1820 located near the rubber pull up grips 1815. In some embodiments, the second elongate bar or pull up bar 18 may comprise eyelets 50 for attaching various devices, for instance, and merely by way of example, chains, swings, straps, weights, bouncy chairs, boxing bags, and other hanging apparatuses.

FIG. 18 further depicts the pair of L-shaped frames 12, 14 joined together as a single frame. Particularly, as shown, the base leg of each L-shaped frame 12, 14, extends beyond the attached second elongate bar or pull up bar 18 to meet the adjacent leg, thereby forming loop 1805. In some embodiments, the loop 1805 may comprise a separate bar secured at the base portion of each L-shaped frame 12, 14. For instance, the separate bar may be secured at the ends of each of the frame rubber grips 1810. Means for securing may be accomplished by methods known in the art, such as, merely by way of example, soldering, adhesives, bolts, fasteners, threads, and springs. In another embodiment, the pair of L-shaped frames 12, 14, may be manufactured from a single tube of material, for instance, by shaping a single tube into a loop 1805 having two L-shaped legs 12, 14. The tube may be manufactured from a variety of materials, such as, and merely by way of example, steel, carbon fiber, titanium, metal alloys, composites, and plastics. In some embodiments, the loop 1805 may comprise additional eyelets for attaching hanging apparatuses, such as swings, bouncy chairs, and boxing bags. The loop 1805 may also comprise rubber grips, thereby functioning as an additional pull up bar device and/or a hanging or swinging bar. Although FIG. 18 shows a conjoined pair of L-shaped frames 12, 14, it is noted that a pair of separate L-shaped frames 12, 14, may be substituted, as shown in a similar configuration in FIG. 1.

FIG. 18 also depicts an example embodiment of a securing member comprising a pair of vice clamps 1820, secured to either end of the second elongate bar or pull up bar 18. The vice clamps 1820 may be configured to apply clamping pressure between two opposing surfaces, for instance, with one jaw abutting a wall side or doorframe and the opposing jaw abutting an opposing surface of the wall side or doorframe. The clamping force applied by each of the vice clamps 1820 is similar to the force achieved in combining the functions of the struts 24 with the locking bar 22 of FIG. 1, which along with the second elongate bar or pull up bar 18, also clamp a portion of the wall received therebetween. In a particular embodiment, the vice clamps 1820 are configured to engage a wall with opposing surfaces, for instance, a surface comprising an inner ridge of a doorframe and an opposing surface of the doorframe. Therefore, the two jaws of each vice clamp 1820 apply opposing pressure on the clamped wall portion received therein, thereby bracketing the second elongate bar or pull up bar 18 against the wall side when deployed. See FIGS. 21, 22, 25, and 26 for further detailed description on the vice clamps 1820 and bracket attachment to the second elongate bar or pull up bar 18.

Figure 19:
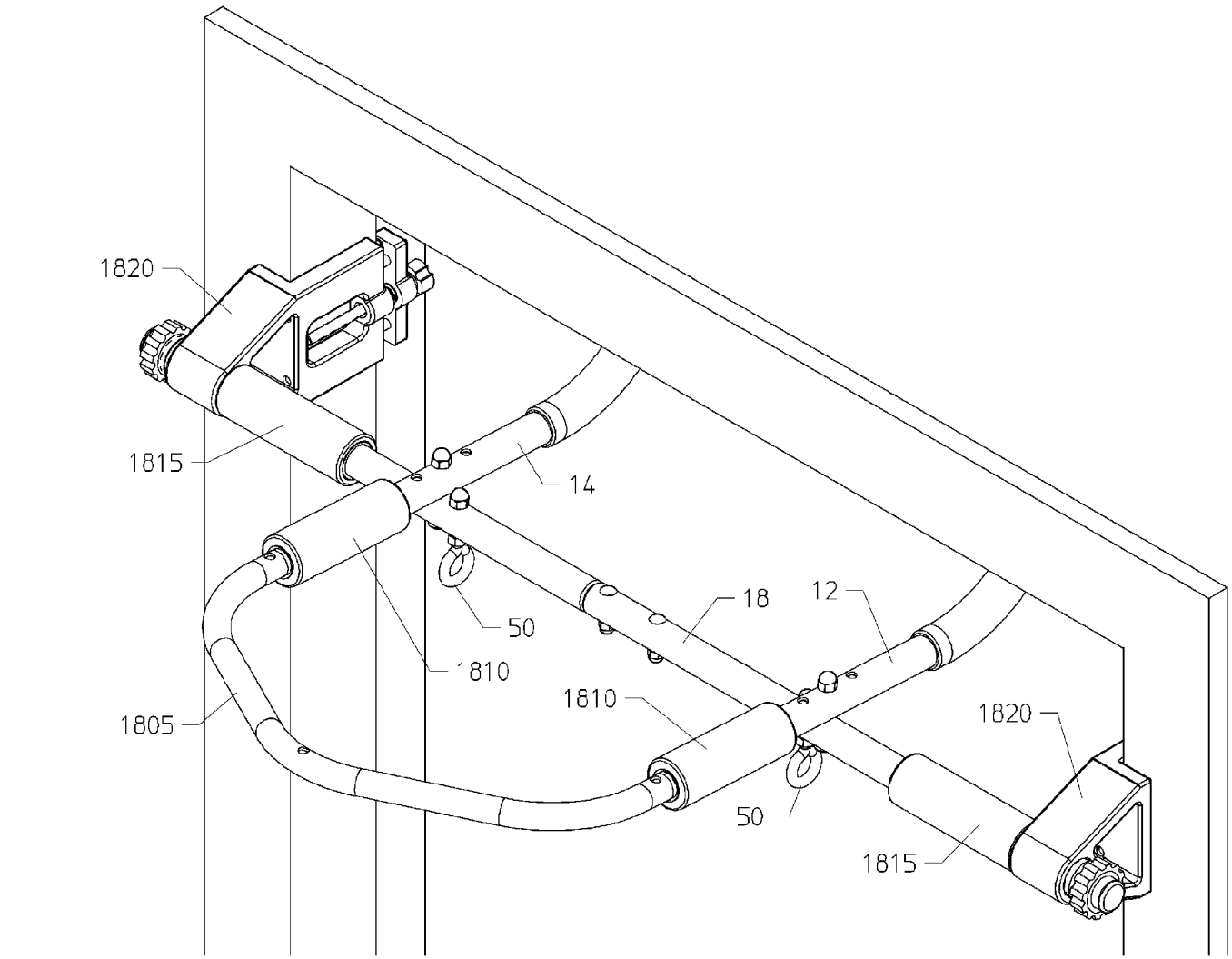
FIG. 19 is a front perspective view of the alternative embodiment of the portable doorway recreation apparatus of FIG. 18, shown mounted to a doorway.

FIG. 19 illustrates a front perspective of the portable doorway recreation apparatus 10 deployed on a doorframe, with the second elongate bar or pull up bar 18 bracketed against the door frame by a securing force provided by the pair of vice clamps 1820. The first elongate bar or support bar 16 engages an upper trim of the doorframe on the opposing side (see FIG. 7). The L-shaped frames 12, 14 are attached to a pair of frame rubber grips 1810, which abut loop 1805 spanning between them. The L-shaped frames 12, 14, are further attached to the second elongate bar or pull up bar 18, which has attached to it a pair of eyelets 50 and a pair of rubber pull up grips 1815. Alternative embodiments may comprise more or less eyelets 50 and rubber pull up grips 1815. The second elongate bar or pull up bar 18 is further received at each end by a pair of vice clamps 1820 which are secured to a doorframe. As shown, the vice clamps 1820 secure an inner ridge of the doorframe and an opposing surface on the outer side of the doorframe. See FIGS. 21 and 22 for further detailed description on the vice clamps 1820 and their attachment to the second elongate bar or pull up bar 18. As deployed in FIG. 19, the portable doorway recreation apparatus 10 may be utilized as a pull-up bar, swinging bar, hanging bar, and a multitude of other functions involving dynamic or static horizontal and/or vertical forces.

Figure 20:
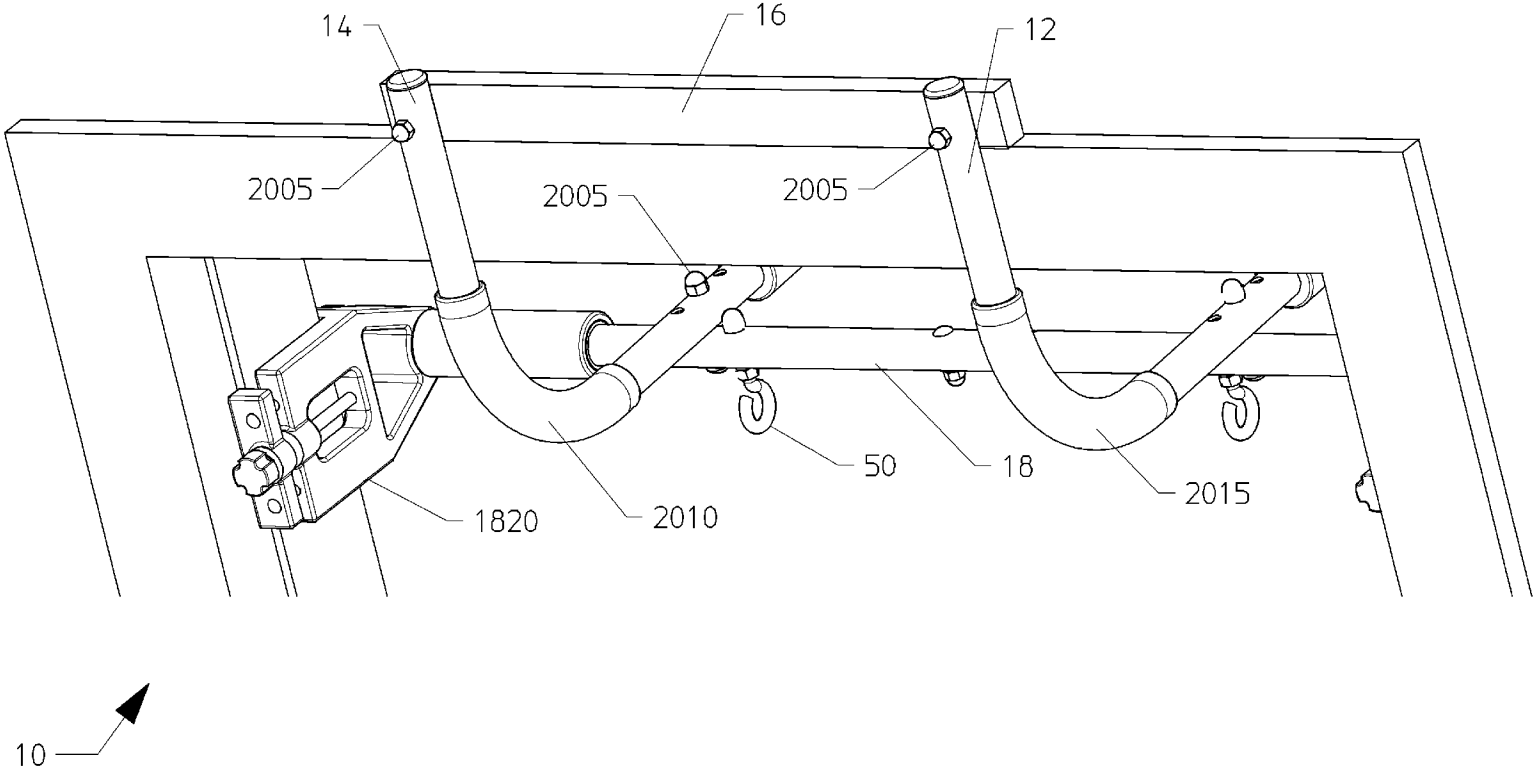
FIG. 20 is a rear perspective view of the alternative embodiment of the portable doorway recreation apparatus of FIG. 18, shown mounted to a doorway.

FIG. 20 depicts a rear view of the portable doorway recreation apparatus 10 deployed on a doorframe, from an opposite side of the doorway as shown in FIG. 19. The first elongate bar or support bar 16 rests on the top trim of the doorframe on a first wall side, and is attached at either end to a pair of L-shaped frames 12, 14. The attachment mechanism shown consists of various nut and bolt combinations 2005. A pair of curved rubber grips 2010, 2015 is also attached to the bent portion of the pair of L-shaped frames 12, 14. The second elongate bar or pull up bar 18 is attached to the base portion of the pair of L-shaped frames 12, 14, by nut and bolt combinations 2005. Eyelets 50 are also provided on the second elongate bar or pull up bar 18. The second elongate bar or pull up bar 18 is further received by a pair of vice clamps 1820 at either end of the bar. As shown, the vice clamp 1820 receives a portion of the doorway from an inner ridge of the doorframe and an opposing surface of the doorframe on the second wall side, opposite the first wall side engaged by the first elongate bar or support bar 16. See FIGS. 21, 22, 25, and 26 for further detailed description on the vice clamps 1820 and their attachment to the second elongate bar or pull up bar 18.

In practice, a user may approach the rear of the portable doorway recreation apparatus 10, hang onto the curved rubber grips 2010, 2015 to elevate his legs above the curved rubber grips 2010, 2015, hook his legs over the loop 1805 (See FIG. 19) or second elongate bar 18, and hang by his legs to perform inverted sit-ups. A variety of other uses may be provided with the given configuration, such as, merely by way of example, pull-ups and swinging. In another aspect, additional bars or devices may be mounted on the pair of L-shaped frames 12, 14, and/or the loop 1805. See FIGS. 24-26 for a description of another embodiment of the portable doorway recreation device having an additional horizontal bar.

Figure 21:
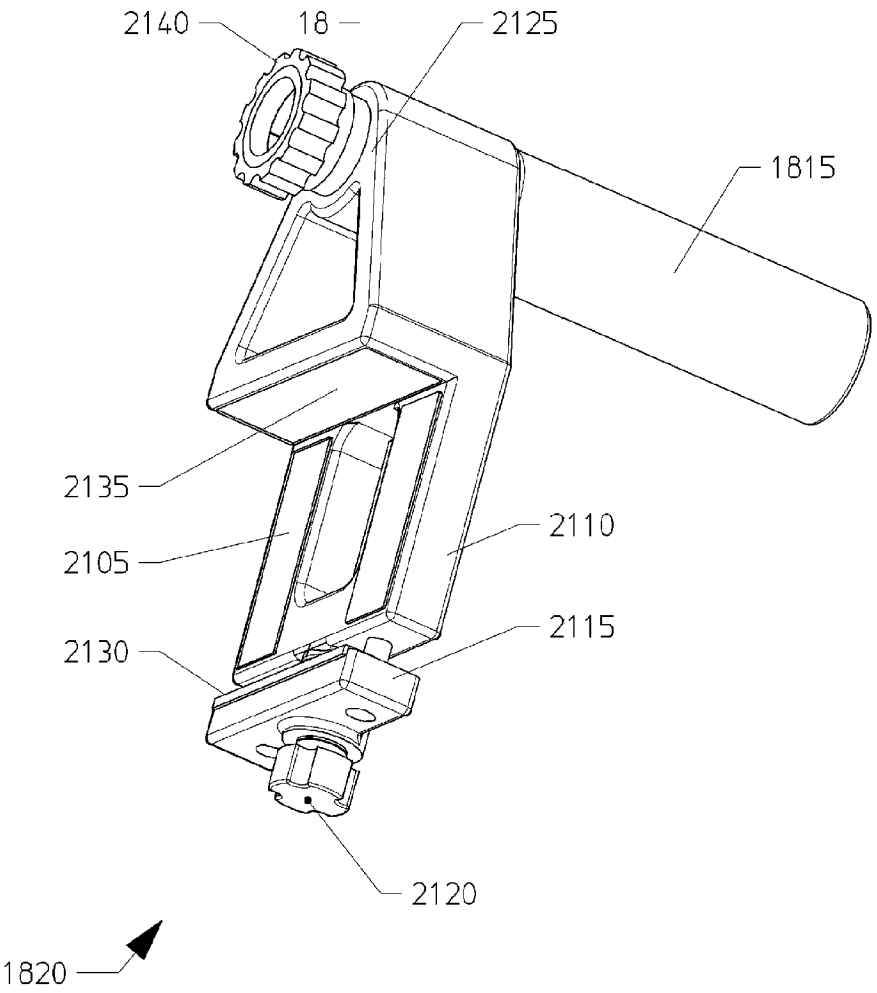
FIG. 21 is a close-up perspective view of a vice clamp and second elongate bar or pull up bar assembly.

FIG. 21 illustrates a close-up perspective view of one embodiment of a vice clamp 1820 joined with one end of the second elongate bar or pull up bar 18. The vice clamp 1820 comprises a vice clamp body 2105 having a fixed jaw 2110 and a parallel movable jaw 2115. A screw grip 2120 attached to the vice clamp 1820 controls the space between the fixed jaw 2110 and the movable jaw 2115. The fixed jaw 2110 further comprises the second surface clammer 2135, and the movable jaw 2115 further comprises the first surface clammer 2130. A bar socket 2125 on a distal portion of the vice clamp body 2105 is configured to receive an end of the second elongate bar or pull up bar 18 inserted therein. The second elongate bar or pull up bar 18 is inserted into the bar socket 2125, and a section of its inserted end is extended slightly beyond the bar socket 2125 as shown, such that the extended end may be further attached to a handle 2140 (see FIG. 23 for further detail). The second elongate bar or pull up bar 18 is also shown as covered by a rubber pull up grip 1815. It is noted that both ends of the second elongate bar or pull up bar 18 and both pairs of vice clamps 1820 are configured as described in FIG. 21. See FIGS. 24-26 for another variation of the vice clamp 1820 and second elongate bar or pull up bar 18 assembly.

As shown in FIG. 21, the screw grip 2120 that is attached to a screw (see FIG. 22) threadably engages the movable jaw 2115 and the fixed jaw 2110, such that by turning the screw grip 2120 clockwise or counterclockwise, the space between the fixed jaw 2110 and movable jaw 2115 may vary, which therefore also varies the space between the first surface clammer 2130 and the second surface clammer 2135. Varying the space between the clammers 2130, 2135 assists in deploying the vice clamp 1820 onto a variety of doorframe or wall thicknesses. The wall or doorframe comprises opposing surfaces such as a first wall side and a second wall side, and is received in the vice clamp 1820 between the first surface clammer 2130 and the second surface clammer 2135. Each clammer 2135, 2130 is configured to flushly abut a wall side. Dialing the screw grip 2120 to close the space between the jaws 2110, 2115 provides a compressive pressure on the wall received between both clammer surfaces 2130, 2135. The pressure forcibly secures the vice clamp 1820 to the wall or doorframe, thereby bracketing the second elongate bar or pull up bar 18 against the second wall side when deployed. It is noted that the movable jaw 2115 comprises a surface area parallel and directly across from the second surface clammer 2135, such that a space may be defined between the first surface clammer 2130 of the movable jaw 2115 and the second surface clammer 2135, the space being utilized for receiving a wall or doorframe.

FIG. 21 illustrates the second elongate bar or pull up bar 18 having an attached handle 2140 at one end. The handle 2140 may comprise a casted in pressure nut to assist in securing the pull up bar 18 in the bar socket 2125. It is noted that both ends of the second elongate bar or pull up bar 18 are configured in this same manner. The components shown in FIG. 21 may be manufactured from a variety of materials, such as, and merely by way of example, steel, plastics, metallic alloys and carbon fibers.

Figure 22:
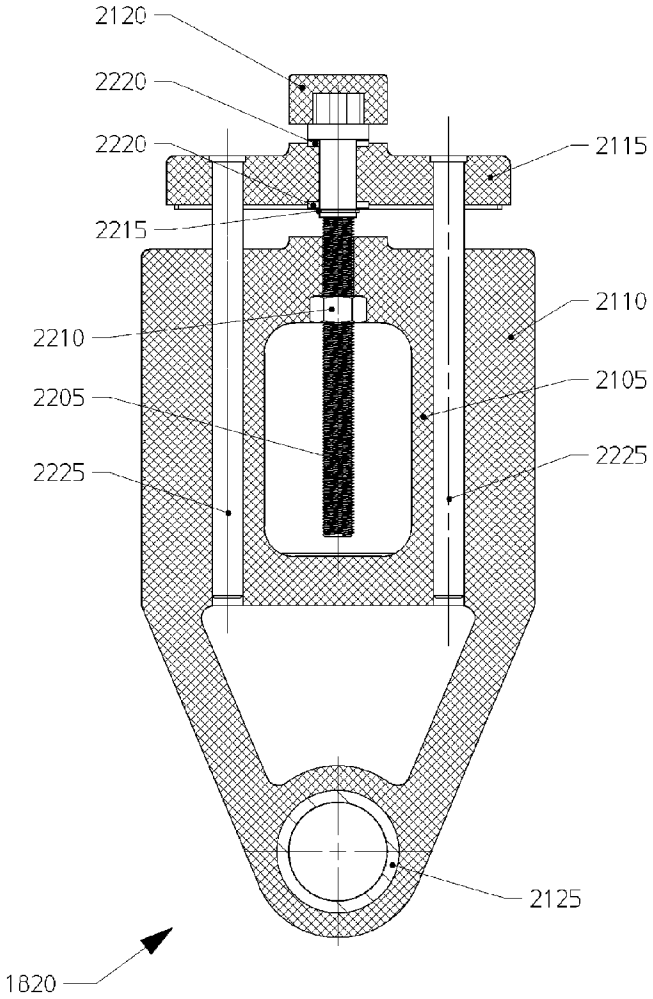
FIG. 22 is a close-up side view of a vice clamp.

FIG. 22 illustrates a close-up side view of a vice clamp 1820. The vice clamp 1820 comprises a vice clamp body 2105, with one end comprising a clamping end and the opposite end comprising a bar socket 2125. The clamping end comprises a fixed jaw 2110 and a parallel, movable jaw 2115. The space between the movable jaw 2115 and the fixed jaw 2110 is adjustable using the screw grip 2120, which is attached to a screw 2205. The screw 2205 may be threaded through top washer 2220, bottom washer 2215, and nut 2210. A pair of steel leaders 2225 extends throughout the movable jaw 2115 and the fixed jaw 2110.

The bar socket 2125 is configured to receive a portion of the second elongate bar or pull up bar 18, as described with respect to FIG. 21. The bar socket 2125 is shown as defined by a circular slot to accommodate a tubular shaped second elongate bar or pull up bar 18. However, other shapes for the bar socket 2125 and second elongate bar or pull up bar 18 may be utilized without sacrificing the features of the present embodiment. The screw grip 2120 is attached to the head of the screw 2205, which is further threaded through a top washer 2220, bottom washer 2215, and nut 2210. In some embodiments, a single washer may sufficiently replace both washers 2220, 2215. Dialing the screw grip 2120 clockwise or counterclockwise directly draws the screw inward or outward from the vice clamp body 2105, thereby moving the movable jaw 2115, which is fixated to the screw by the top washer 2220 and bottom washer 2215, toward or away from the vice clamp body 2105. Movement of the jaws 2110, 2115 would adjust the distance between the clammers 2130, 2135 as described in FIG. 21. The pair of steel leaders 2225 align and guide the jaws 2110, 2115 during movement.

Figure 23:
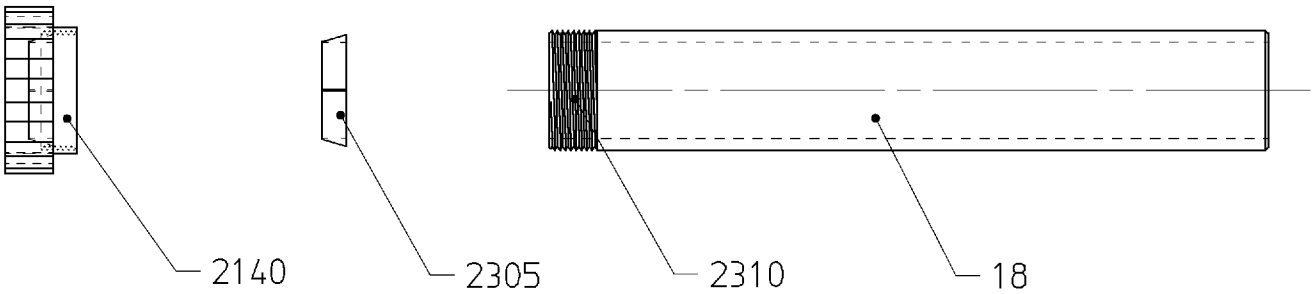
FIG. 23 is a close-up exploded view of one end of the second elongate bar or pull up bar.

FIG. 23 illustrates a close-up exploded view of one end of the second elongate bar or pull up bar 18. The second elongate bar or pull up bar 18 comprises a threaded end 2310. The handle 2140 may comprise a casted in pressure nut and internal threads for receiving the threaded end 2310. A cone 2305 may be attached between the handle 2140 and the threaded end 2310.

As shown in FIG. 23, the handle 2140 may threadably engage the threaded end 2310 of the second elongate bar or pull up bar 18, thereby securing the pull up bar 18 when inserted at the bar socket 2125 (see FIG. 21). The cone 2305 may be provided to prevent over-engagement of the handle 2140 when attached to the threaded end 2310.

Figure 24:
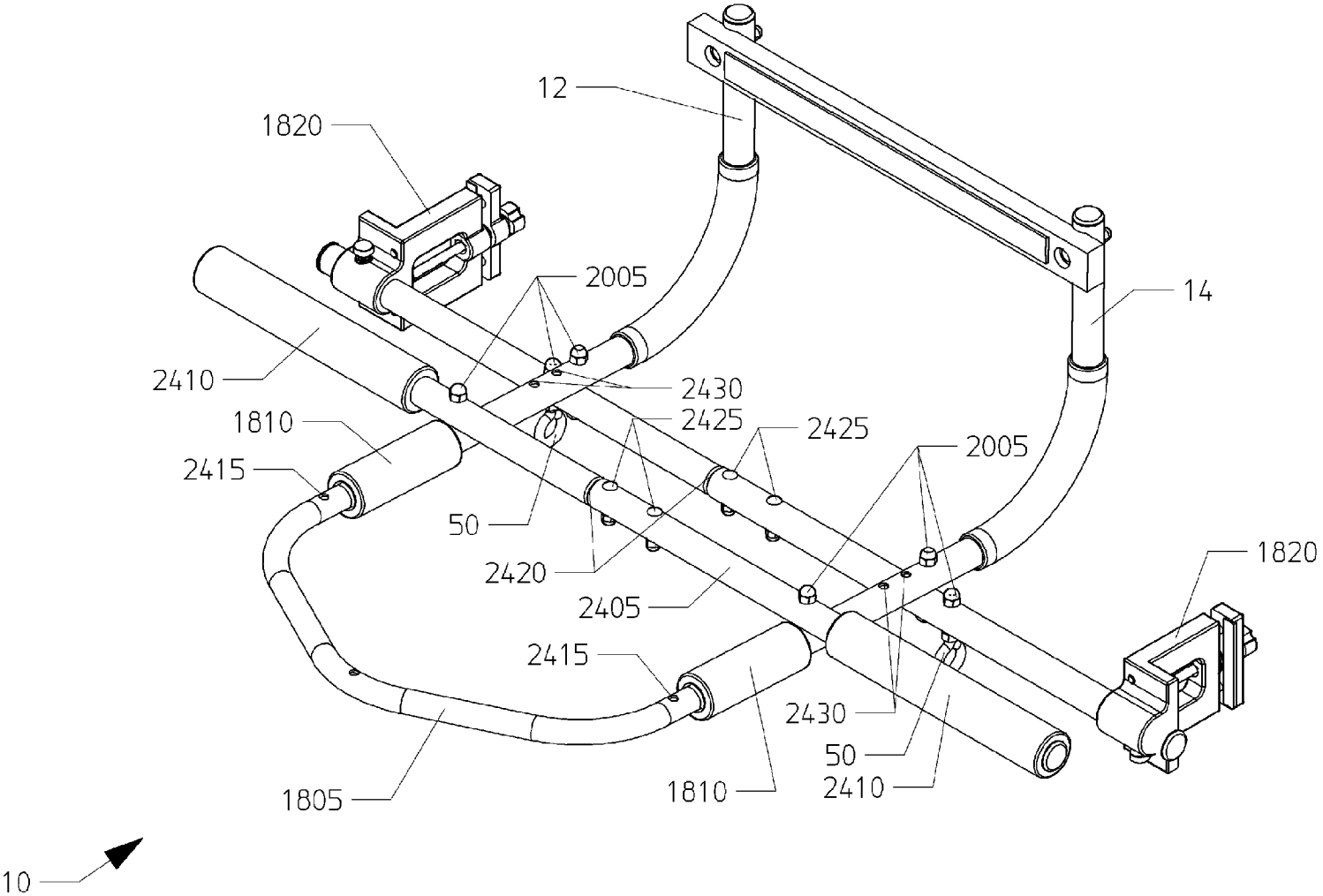
FIG. 24 is a front perspective view of the portable doorway recreation apparatus with an add-on bar.

FIG. 24 illustrates a front view of an embodiment of the portable doorway recreation apparatus 10 having additional bars attached, such as add-on bar 2405. The add-on bar 2405 may be attached underneath or on top (as shown) of the L-shaped frames 12, 14 with various nut and bolt combinations 2005 at various add-on bar openings 2415. The various openings 2415, located along the frames 12, 14 and/or loop 1805, allow a user to reposition the add-on bar 2405, for instance, to attach to an opposite end of the frame rubber grips 1810. The add-on bar 2405 may comprise additional add-on grips 2410 at both ends of the add-on bar 2405 for use as a pull-up bar, and/or comprise additional eyelets and hooks. The L-shaped frames 12, 14 may have attached a pair of frame rubber grips 1810, loop 1805, and the second elongate bar or pull up bar 18, which is shown secured to the door frame at either end by a pair of vice clamps 1820. The second elongate bar or pull up bar 18 may further provide a pair of eyelets 50. The components of the portable doorway recreation device 10 may be joined by multiple nut and bolt combinations 2005, as illustrated in FIG. 24, or may be joined with various other attachments known in the art that allow for detachment of some or all of the components from other components, thereby maintaining portability of the portable doorway recreation apparatus 10. In some embodiments, as shown in FIG. 24, the add-on bar 2405 and/or second elongate bar or pull up bar 18 may further comprise bar joints 2420 and/or retractable spring snaps 2425, for adjusting the length of the bars. For instance, the length of the add-on bar 2405 may be contracted or elongated at a bar joint 2420 that may telescopingly receive one end of the add-on bar 2405 into the other end, whereby the ends may be fixed together using retractable spring snaps 2425, or threads, threaded extension pipes, or various other impermanent means for joining the add-on bar 2405 components together. In another aspect, the L-shaped frames 12, 14 may comprise one or more second elongate bar openings 2430 for securing the L-shaped frames 12, 14, to the second elongate bar or pull up bar 18. In this way, the portable doorway recreation device 10 may receive various doorway thicknesses by adjusting the position of the second elongate bar or pull up bar 18 along the L-shaped frames 12, 14.

Figure 25:
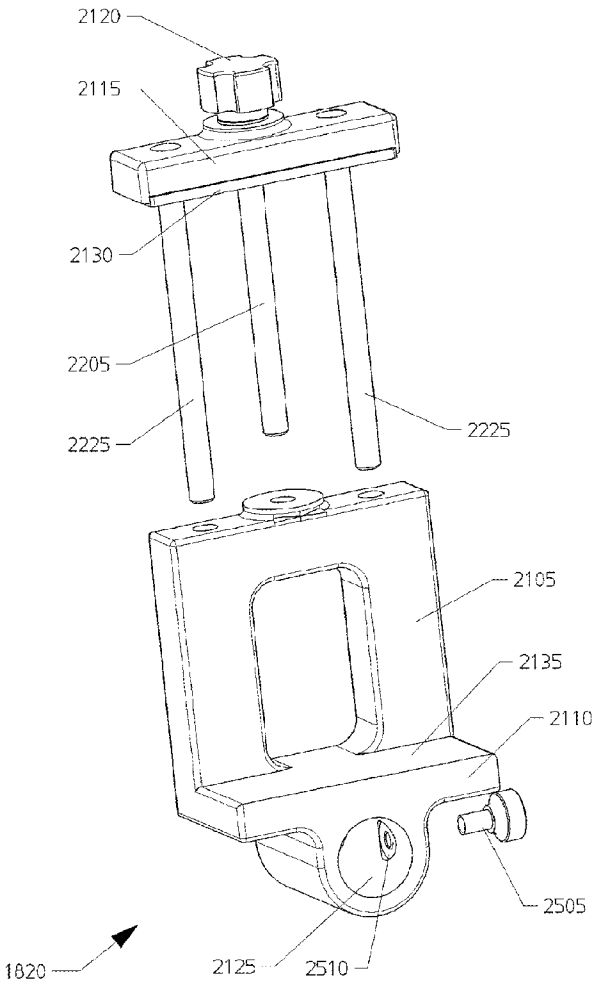
FIG. 25 is an exploded close-up view of an alternative embodiment of a vice clamp.

FIG. 25 is an exploded close-up view of the vice clamp 1820 also depicted in FIG. 24. The vice clamp 1820 comprises a vice clamp body 2105 connected to a portion of a fixed jaw 2110 which provides a second surface clammer 2135 on one side of the fixed jaw 2110, and a bar socket 2125 on the opposite side of the second surface clammer 2135. The bar socket 2125 further comprises a securing screw orifice 2510 that is operatively associated with a securing screw 2505, whereby the assembly is configured to secure a second elongate bar or pull up bar 18. The distal end of the vice clamp body 2105 is configured to receive the movable jaw 2115. The movable jaw 2115 comprises a first surface clammer 2130 and screw 2205 having an associated screw grip 2120, such that the movable jaw 2115 may be secured to the vice clamp body 2105 by inserting its attached screw 2205 and steel leaders 2225.

Similar to the configuration of the vice clamp 1820 as depicted in FIGS. 21 and 22, the vice clamp 1820 illustrated in FIG. 25 is configured to receive a portion of the doorframe between the first surface clammer 2130 of the movable jaw 2115 and the second surface clammer 2135 of the fixed jaw 2110. The distance separating the first surface clammer 2130 and the second surface clammer 2135, and therefore the force on the portion of the doorframe received therein, may be controlled by turning the screw grip 2120 to advance and retract the first surface clammer 2130 relative to the second surface clammer of the vice clamp body 2105.

Figure 26:
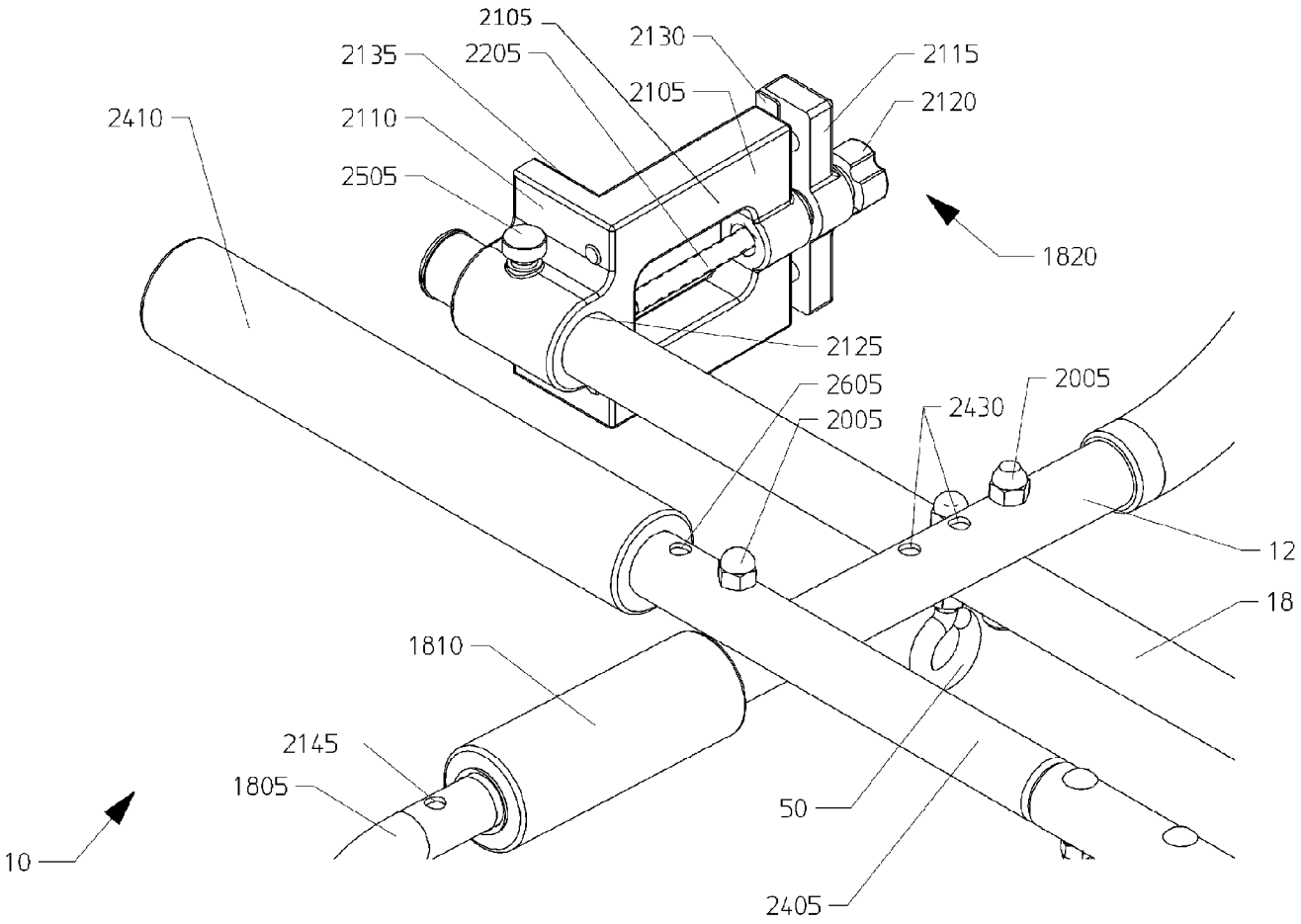
FIG. 26 is a close-up perspective view of the vice clamp and add-on bar of FIGS. 24 and 25, as deployed on a door frame.

Alternative to the vice clamp 1820 depicted in FIGS. 21 and 22, the vice clamp 1820 illustrated in FIG. 25 is configured to receive the second elongate bar or pull up bar 18 at the bar socket 2125, and further secure the second elongate bar or pull up bar 18 at the bar socket 2125 by engaging the bar 18 to the vice clamp 1820 with securing screw 2505. The securing screw 2505 may be inserted through the securing screw orifice 2510 to contact and engage the second elongate bar or pull up bar 18. In some embodiments, the second elongate bar or pull up bar 18 may comprise an additional orifice for receiving, for instance and merely by way of example, threadably receiving, the securing screw 2505. In other embodiments, the screw 2505 may simply slide into orifice 2510 and/or a slot on the pull up bar 18 received therein FIG. 26 illustrates a close-up perspective of the vice clamp 1820 and the add-on bar 2405 of the portable doorway recreation apparatus 10 deployed on one edge of a doorframe. The vice clamp 1820 comprises a vice clamp body 2105 connected to a fixed jaw 2110 having on one side a second surface clammer 2135 flush against the second wall side, and on the other side a bar socket 2125 operatively associated with a securing screw 2505 and a second elongate bar or pull up bar 18 received therein. On the distal portion of the vice clamp body 2105, the screw 2205 of the movable jaw 2115 is received through the vice clamp body 2105, thereby securing the first surface clammer 2130 of the movable jaw 2115 flush against the first wall side by turning the screw grip 2120 that is operatively attached to the screw 2205. The second elongate bar or pull up bar 18 is directly received through the bar socket 2125 and securably engaged by the securing screw 2505. The second elongate bar or pull up bar 18 comprises eyelets 50, a plurality of second elongate bar openings 2430, and attaches to the L-shaped frame 12 by various nut and bolt combinations 2005. The L-shaped frame 12 is further attached to add-on bar 2405 with a nut and bolt combination 2005. The add-on bar 2405 provides additional slots 2605 for attaching the add-on bar 2405 to the L-shaped frame 12 with the nut and bolt combination 2005. The L-shaped frame 12 further comprises add-on bar openings 2415 throughout the frame 12, whereby the openings 2415 may continue up to and/or throughout the loop 1805.

In some embodiments, the attachment of the pull up bar 18 and the L-shaped frame 12 may be achieved directly by way of securing an end of the eyelet 50 through both the pull up bar 18 and the L-shaped frame 12. In another embodiment, as depicted in FIG. 26, the pull up bar 18 and L-shaped frame 12 are attached by various nut and bolt combinations 2005, whereby the L-shaped frame 12 might further comprise a plurality of second elongate bar openings 2430 for varying the positioning of the L-shaped frame 12 in the doorframe to accommodate various doorframe thicknesses. In another aspect, the add-on bar 2405 may have variable length adjusted by a user. The additional slot 2605, which may be located at both ends of the add-on bar 2405, may accompany an add-on bar 2405 having adjustable lengths as described in FIG. 24. Add-on grips 2410 are located at the end of the add-on bar 2405. The add-on grip 2410 may be oriented perpendicular to the frame rubber grips 1810 located on the L-shaped frame 12, as illustrated in FIG. 26, or in another embodiment, the add-on grip 2410 may be oriented in parallel to the frame rubber grips 1810, or various other orientations relative to the frame rubber grips 1810, such as, and merely by way of example, parallel or perpendicular in differing x-y-z planes.

Figure 27:
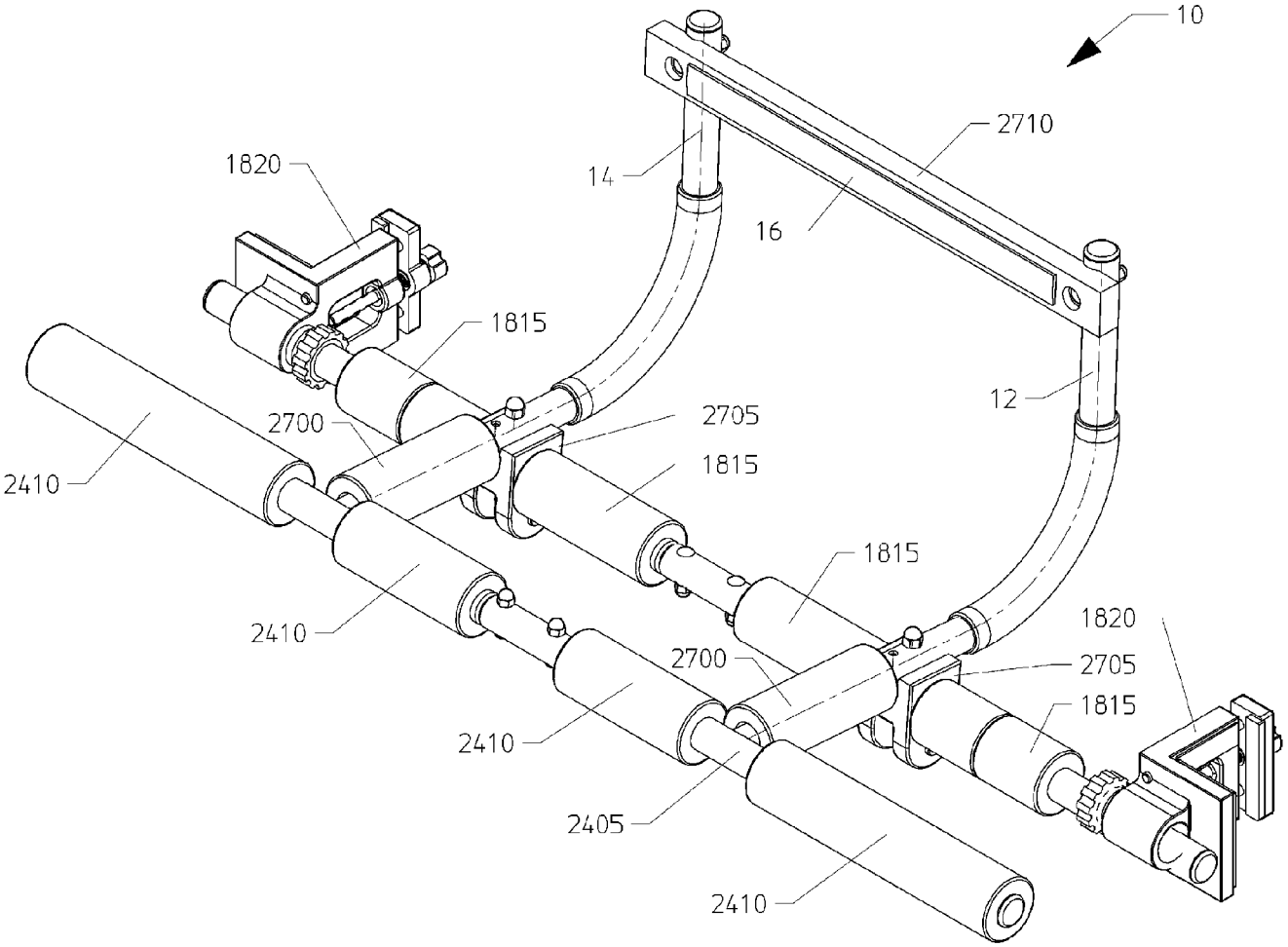
FIG. 27 is a perspective view of an alternative embodiment of the portable doorway recreation apparatus having an add-on bar attached directly to the L-shaped frames.

FIG. 27 illustrates an alternative embodiment of the portable doorway recreation apparatus 10 having the add-on bar 2405 attached directly to the L-shaped frames 12, 14. The add-on bar 2405 may provide a plurality of add-on grips 2410 and a pair of slots 2700 to receive the ends of the L-shaped frames 12, 14. The second elongate bar or pull up bar 18 may comprise a plurality of pull up grips 1815 and a pair of swing supports 2705 to hookably receive other swinging and hanging devices. A pair of vice clamps 1820 may be received at the ends of the second elongate bar or pull up bar 18 for securing the apparatus 10 on a doorway. A first elongate bar or support bar 16 spanning a distance between the L-shaped frames 12, 14 may comprise padding 2710 for abutting the surface of a first wall side when deployed on a doorframe.

Figure 28:
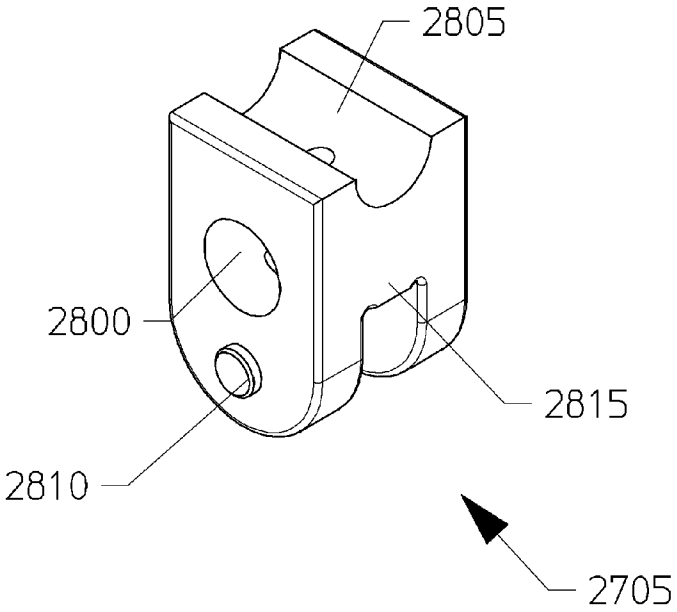
FIG. 28 is a close-up illustration of a swing support.
Figure 29:
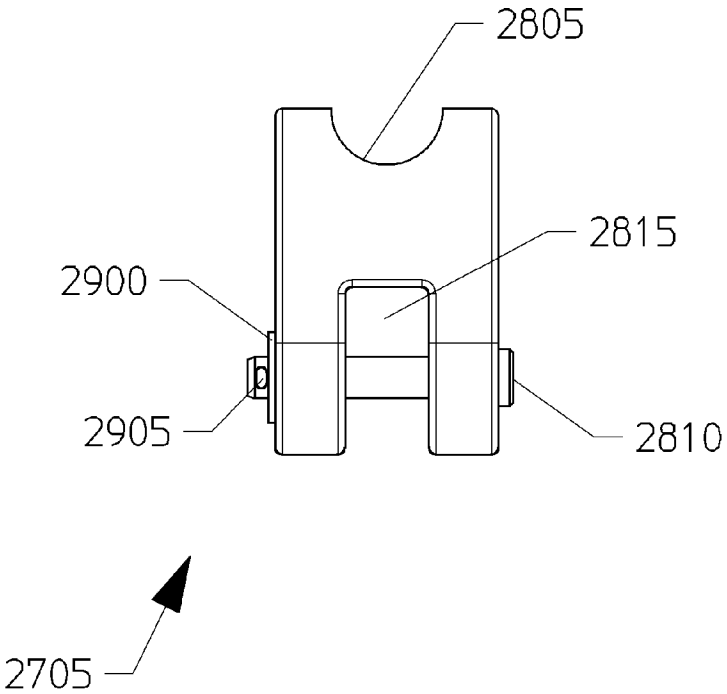
FIG. 29 is a side view of the swing support.

FIG. 28 is a close-up illustration of one of the pair of swing supports 2705 shown in FIG. 27. The swing support 2705 may comprise a socket 2800 for receiving the second elongate bar or pull up bar 18 and a groove 2805 for resting a portion of one of the L-shaped frames 12, 14 on a top portion of the swing support 2705, thereby securing the bars at a right angle. A detachable rod 2810 may be provided on a lower portion of the swing support 2705 and span a gap 2815, which exposes the rod 2810 for attachment to other hookable, swinging, and/or hanging devices. FIG. 29 is a side view of the swing support 2705. In one embodiment, the rod 2810 may comprise a detachable clevis pin that may be secured by a washer 2900 and cotter pin 2905 assembly. The body of the swing support 2705 may be manufactured from durable and strong plastics or other suitable materials including metallic materials.

Figure 30:
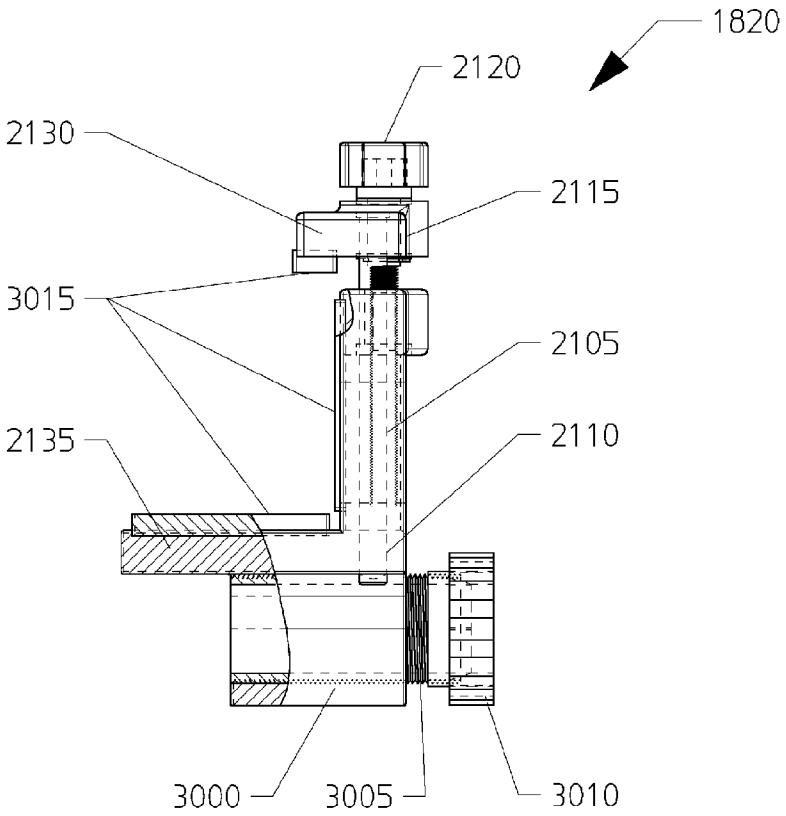
FIG. 30 is a close-up illustration of an alternative embodiment of a vice clamp.

FIG. 30 is a close-up illustration of the one of the pair of vice clamps 1820 shown in FIG. 27. The vice clamp 1820 may comprise a vice clamp body 2105 connected to a portion defined as a fixed jaw 2110. The vice clamp 1820 may be made of a suitable durable plastic or metal. One side of the fixed jaw 2110 may provide a second surface clammer 2135, and the opposite side may provide a tube socket 3000 for engaging a threaded fixator 3005. The threaded fixator 3005 may be a hollow tube that is threaded on its outer surface and configured to receive a portion of the second elongate bar or pull up bar 18 inserted within the tube, whereby twisting the knob 3010 in either direction either releases or engages the pull up bar 18 to the vice clamp 1820. For instance, tightening the knob 3010 may compress a plastic sleeve around the pull up bar 18 inserted within the threaded fixator 3005, thereby securing the pull up bar 18 onto the vice clamp 1820. In an aspect, the fixator 3005 assembly may be utilized to increase the overall length of the second elongate bar or pull up bar 18 to fit wider door frames.

The vice clamp 1820 shown in FIG. 30 may further engage a movable jaw 2115 that provides a first surface clammer 2130 and a screw grip 2120, whereby turning the screw grip 2120 either direction may vary the distance between the first surface clammer 2130 and the second surface clammer 2135. A rubber padding 3015 may be adhered to portions of the vice clamp 1820 in contact with a doorframe, such as the first surface clammer 2130, second surface clammer 2135, and vice clamp body 2105.

Various embodiments of the disclosure could also include permutations of the various elements recited in the claims as if each dependent claim was a multiple dependent claim incorporating the limitations of each of the preceding dependent claims as well as the independent claims. Such permutations are expressly within the scope of this disclosure.

The description of the various embodiments has been presented for purposes of illustration and description, but is not intended to be exhaustive or limiting of the invention or the claims thereto to the form disclosed. Many modifications and variations will be apparent to those of ordinary skill in the art. The embodiment described and shown in the figures was chosen and described in order to best explain the principles of the invention, the practical application, and to enable others of ordinary skill in the art to understand the invention for various embodiments with various modifications as are suited to the particular use contemplated. All references cited herein are incorporated in their entirety by reference.

What is claimed is:

1. A portable doorway recreation device for use on a doorway frame comprising:

an L-shaped frame;

a first horizontal elongate bar attached to a riser of the L-shaped frame;

a second horizontal elongate bar attached to a base of the L-shaped frame;

a securing member operatively associated with the second elongate bar, wherein with the first elongate bar resting on top of the doorway frame on a first wall side and the second elongate bar operatively associated with a second wall side parallel to the first wall side, the securing member is configured to engage one of the first and second wall sides to prevent movement of the second elongate bar away from the second wall side.

2. The portable doorway recreation device of claim 1, wherein the securing member comprises a locking bar in contact with the first wall side, the locking bar attached to the second elongate bar by at least one telescoping strut.

3. The portable doorway recreation device of claim 1, wherein the securing member comprises a pad pivotably attached to the base of the L-shaped frame for contact with the second wall side.

4. The portable doorway recreation device of claim 3, wherein pivoting the pad upward against the second wall side receives a portion of the wall between the pad and the first elongate bar.

5. The portable doorway recreation device of claim 4, wherein the securing member further comprises a strut at one end pivotably attached to the base of the L-shaped frame and at a second end attached to the pad and at least one turnbuckle operatively connecting the base of the L-shaped frame to the strut, whereby tightening the turnbuckle pivots the pad against the second wall side.

6. The portable doorway recreation device of claim 1, wherein the securing member comprises a locking bar attached to the base of the L-shaped frame configured to contact the second wall side.

7. The portable doorway recreation device of claim 6, wherein the locking bar is configured to contact the second wall side opposite the first horizontal elongate bar, the locking bar further comprising means for applying a squeezing force on a portion of the wall received between the first horizontal elongate bar and locking bar.

8. The portable doorway recreation device of claim 7, wherein means for squeezing comprises a screw operatively associated with a twistable knob, the screw comprising the base of the L-shaped frame, whereby twisting of the knob a first direction moves the locking bar closer to the first elongate bar and twisting the knob a second direction moves the locking bar away from the first elongate bar.

9. The portable doorway recreation device of claim 1, wherein the second horizontal elongate bar further comprises grips.

10. The portable doorway recreation device of claim 1, wherein the base end of the L-shaped frame further comprises grips.

11. The portable doorway recreation device of claim 1, wherein the second horizontal elongate bar further comprises at least one hinge operatively connected to a swing for supporting an angular momentum of the swing at a radius from the second horizontal elongate bar.

12. The portable doorway recreation device of claim 1, wherein the second horizontal elongate bar further comprises a pad at each end in contact with the second wall side.

13. The portable doorway recreation device of claim 1, wherein the securing member further comprises padded ends at each end in contact with one of the first and second wall sides.

14. The portable doorway recreation device of claim 1, further comprising a pair of spaced L-shaped frames, the first horizontal elongate bar attached to the riser of each L-shaped frame, the second horizontal elongate bar attached to the base of each L-shaped frame, and the securing member operatively associated with the second elongate bar.

15. The portable doorway recreation device of claim 1, wherein the securing member comprises a pair of vice clamps at either end of the second elongate bar, the vice clamps configured to receive a portion of the first and second wall sides.

16. The portable doorway recreation device of claim 15, wherein the portion of the first wall side received by the vice clamp comprises an inner ridge of a doorframe having a surface opposing the second wall side.

17. The portable doorway recreation device of claim 15 wherein the second elongate horizontal bar is operatively associated with the vice clamps in a manner wherein the vice clamps are in direct physical contact with the second wall side.

18. A method of attaching a portable doorway recreation device to a doorway frame, the portable doorway device comprising an L-shaped frame, a first horizontal elongate bar attached to a riser of the L-shaped frame, a second horizontal elongate bar attached to a base of the L-shaped frame, and a securing member operatively associated with the second elongate bar, the method comprising:

resting the first horizontal elongate bar on top of the doorway frame on a first wall side;

operatively associating the second horizontal elongate bar with a second wall side parallel to the first wall side;

and forcibly engaging the securing member into contact with one of the first and second wall sides to prevent movement of the second elongate bar away from the second wall side.

19. The method of claim 18, wherein means for forcibly engaging the securing member into contact with one of the first and second wall sides comprises clamping a portion of the wall from the first and second wall sides.

20. The method of claim 19, wherein the clamped portion of the first wall side comprises an inner ridge of a doorframe having a surface opposing the second wall side.

* * * * *